US007422311B2

(12) United States Patent
Sugahara

(10) Patent No.: US 7,422,311 B2
(45) Date of Patent: Sep. 9, 2008

(54) LIQUID TRANSPORT HEAD AND LIQUID TRANSPORT APPARATUS PROVIDED WITH THE SAME

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 348 days.

(21) Appl. No.: 11/084,800

(22) Filed: Mar. 21, 2005

(65) Prior Publication Data

US 2005/0219330 A1 Oct. 6, 2005

(30) Foreign Application Priority Data

Mar. 31, 2004 (JP) ..... 2004-107161

(51) Int. Cl.
*B41J 2/04* (2006.01)

(52) U.S. Cl. ..... 347/54

(58) Field of Classification Search ..... 347/54
See application file for complete search history.

(56) References Cited

U.S. PATENT DOCUMENTS

| | | | | |
|---|---|---|---|---|
| 6,231,177 | B1 * | 5/2001 | Cherukuri et al. | 347/105 |
| 6,375,311 | B1 | 4/2002 | Kuramoto | |
| 6,538,823 | B2 | 3/2003 | Kroupenkine et al. | |
| 6,545,815 | B2 | 4/2003 | Kroupenkine et al. | |
| 6,995,024 | B2 * | 2/2006 | Smith et al. | 436/180 |
| 2003/0108804 | A1 | 6/2003 | Cheng et al. | |
| 2003/0202051 | A1 | 10/2003 | Ito et al. | |

FOREIGN PATENT DOCUMENTS

| | | | |
|---|---|---|---|
| EP | 0 940 255 | A1 | 9/1999 |
| EP | 0940255 | A1 * | 9/1999 |
| EP | 0 972 640 | A1 | 1/2000 |
| JP | A 04-257485 | | 9/1992 |
| JP | A 11-138791 | | 5/1999 |
| JP | A 11-227219 | | 8/1999 |
| JP | A 2001-013306 | | 1/2001 |

(Continued)

OTHER PUBLICATIONS

Ed Colgate et al.; "An investigation of electrowetting-based microactuation", 8257a, Journal of Vacuum Science & Technology, 8(1990) Jul./Aug., No. 4, New York, US, pp. 3625-3633.

*Primary Examiner*—Julian D Huffman
(74) *Attorney, Agent, or Firm*—Oliff & Berridge, PLC

(57) ABSTRACT

A liquid transport apparatus includes a flow passage which has a liquid discharge port and which includes a first area and a second area formed on an inner wall to make contact with a liquid, the second area being adjacent to the first area in a flow direction of the liquid and having liquid repellence higher than that of the first area. When the pressurized liquid is supplied to the flow passage toward the liquid discharge port, then the liquid is incapable of passing through the second area owing to the liquid repellence of the second area, and thus a gas stays in the second area in accordance therewith. The liquid transport apparatus further includes a liquid passage-permitting mechanism which selectively permits the pressurized liquid to pass through the second area. The apparatus is provided, wherein the high integration can be easily realized, and the flow passage is simply constructed.

40 Claims, 20 Drawing Sheets

FOREIGN PATENT DOCUMENTS

| | | |
|---|---|---|
| JP | A 2003-050303 | 2/2003 |
| JP | A 2003-177219 | 6/2003 |
| JP | A 2003-185829 | 7/2003 |
| JP | A 2003-326712 | 11/2003 |
| WO | WO 03/070381 A1 | 8/2003 |

* cited by examiner

LIQUID TRANSPORT HEAD AND LIQUID TRANSPORT APPARATUS PROVIDED WITH THE SAME

BACKGROUND OF THE INVENTION

1. Field of the Invention

The present invention relates to a liquid transport head which makes it possible to control the flow of a liquid in a flow passage, and a liquid transport apparatus provided with the same.

2. Description of the Related Art

An ink-jet head, which discharges an ink to form an image on the recording paper, is known. As described in U.S. Patent Application Publication No. 2003/202051 A1 corresponding to Japanese Patent Application Laid-open No. 2003-326712, the ink-jet head as described above includes those of the type based on the use of the piezoelectric element. In the case of the ink-jet head of the piezoelectric type, when the volume of an ink chamber called "pressure chamber" is varied by an actuator which includes the piezoelectric element, the ink is discharged from a nozzle which is communicated with the pressure chamber. The ink-jet head of the piezoelectric type can use various liquids in addition to the ink as the liquid to be discharged, in which it is possible to realize the precise liquid droplet control and the liquid droplet gradation. The ink-jet head of the piezoelectric type is advantageous in that the durability is excellent.

In recent years, it has been demanded to develop an ink-jet head having a compact size while possessing a large number of nozzles. However, in the case of the ink-jet head of the piezoelectric type, the size of the pressure chamber cannot be decreased to be smaller than a predetermined size when it is intended to secure a certain amount of ink discharge. Therefore, the ink-jet head of the piezoelectric type is not suitable for the realization of the high integration. In other words, it is impossible to arrange the nozzles at a high density, and the head, in which a large number of the nozzles are formed, is consequently large-sized. Further, in the case of the ink-jet head of the piezoelectric type, the flow passage including the pressure chamber is constructed in a complicated manner, in which the production steps tend to be confusing.

SUMMARY OF THE INVENTION

An object of the present invention is to provide an apparatus which may replace the ink-jet head of the piezoelectric type, which is suitable for the realization of the high integration, and which has a simplified flow passage structure.

According to a first aspect- of the present invention, there is provided a liquid transport head comprising:

a flow passage which has a liquid discharge port and which includes a first area and a second area formed on an inner wall which makes contact with a liquid, the second area being adjacent to the first area in a flow direction of the liquid and having liquid repellence higher than that of the first area, wherein the liquid, which is pressurized to move toward the liquid discharge port, is incapable of passing through the second area to move toward the liquid discharge port, and thus a gas stays in the second area; and a liquid passage-permitting mechanism which selectively permits the pressurized liquid to pass through the second area.

According to the present invention, the head, which is capable of selectively discharging the liquid, successfully has the relatively simple structure which can be highly integrated with ease and which can be easily miniaturized.

In the liquid transport head according to the present invention, a pressure, which is applied to the liquid, may be varied or fluctuated. By doing so, it is possible to easily perform the switching between the state in which the liquid is discharged and the state in which the liquid is not discharged.

In the liquid transport head according to the present invention, one or more bumps may be formed at one or more positions corresponding to one or more edges of the second area in the flow direction of the liquid on the inner wall. According to this arrangement, the gas, which stays at the position corresponding to the second area, hardly moves. Therefore, the stability of the meniscus position is improved. As a result, the reliability is improved for the switching between the state in which the liquid is discharged and the state in which the liquid is not discharged. Further, the liquid, which passes through or across the second area, has a constant volume.

In the liquid transport head according to the present invention, a surface of the second area, which makes contact with the liquid, may protrude as compared with a surface of the first area which makes contact with the liquid. According to this arrangement, the gas, which stays at the position corresponding to the second area when the liquid is interrupted, hardly moves. Therefore, the stability of the meniscus position is improved. As a result, the reliability is improved for the switching between the state in which the liquid is discharged and the state in which the liquid is not discharged. Further, the liquid, which passes across the second area, has a constant volume.

In the liquid transport head according to the present invention, the flow passage may have an opening which is open to atmospheric air so that a cross section of the flow passage is formed to be recessed, and the opening may extend in the flow direction of the liquid. According to this arrangement, the structure is further simplified, and the liquid transport head can be produced at low cost.

In the liquid transport head according to the present invention, an outer wall of the flow passage, with which the opening is formed, may be formed to have liquid repellence which is higher than that of the first area. According to this arrangement, when the liquid transport head has the opening which is open to the atmospheric air so that the flow passage is formed to have the recessed cross section, it is possible to suppress the liquid contained in each flow passage from any leakage to the outside of the flow passage.

In the liquid transport head according to the present invention, the liquid may be an ink. According to this arrangement, the printing can be performed at a high resolution by discharging the ink onto the recording medium.

In the liquid transport head according to the present invention, the flow passage may have a plurality of individual flow passages, and the liquid discharge port may include discharge ports which correspond to the plurality of individual flow passages and which are arranged to form an array. According to this arrangement, it is possible to simultaneously discharge the liquid in a form of straight line from the large number of discharge ports.

The liquid transport head according to the present invention may further include a first common flow passage which is connected to an individual flow passage of the individual flow passages assigned by an ordinal number of $(n \times N+1)$, a second common flow passage which is connected to an individual flow passage assigned by an ordinal number of $(n \times N+2)$, . . . , and an nth common flow passage which is connected to an individual flow passage assigned by an ordinal number of (n×N+n) as counted from an individual flow passage disposed at an outermost end provided that n represents a fixed natural number of not less than 2, and N represents a variable integer of not less than 0, wherein n pieces of the common flow passages may be formed at positions different in distance with respect to the associated individual flow passages respectively. According to this arrangement, it is possible to simultaneously discharge the liquids of a plurality of types at identical spacing distances in a form of straight line.

In the liquid transport head according to the present invention, the n pieces of the common flow passages may be filled with inks which have different colors as the liquid respectively. According to this arrangement, it is possible to record a color image by discharging the inks onto the recording medium.

The liquid transport head according to the present invention may further include a common flow passage which is commonly connected to the plurality of individual flow passages. According to this arrangement, it is possible to simplify the structure for supplying the liquid to the flow passage.

In the liquid transport head according to the present invention, the liquid passage-permitting mechanism may include a first electrode which is formed at a position different from a position corresponding to the second area; an insulator which is formed as an inner wall of the flow passage in the second area; and a second electrode which is electrically connected to the insulator. According to this arrangement, the liquid passage-permitting mechanism has no movable member. Therefore, it is possible to suppress the failure. Further, it is possible to reduce the electric power consumption.

In the liquid transport head according to the present invention, the first electrode may be formed on a side opposite to the liquid discharge port with respect to the position corresponding to the second area. According to this arrangement, it is possible to deform the interface between the liquid and the gas in accordance with the electrowetting phenomenon. In this situation, the pressurized liquid passes across the position corresponding to the second area. Therefore, even when a small voltage is applied, it is possible to allow the pressurized liquid to pass.

In the liquid transport head according to the present invention, the first electrode may be formed in the common flow passage. According to this arrangement, the first electrode can be used commonly for a plurality of the liquid passage-permitting mechanisms.

In the liquid transport head according to the present invention, the liquid passage-permitting mechanism may include an oscillation mechanism which vibrates the inner wall of the flow passage at least in the second area. According to this arrangement, the acceleration can be applied to the liquid disposed on the upstream side in the flow direction of the fluid from the second area, the acceleration being sufficient to make the liquid to ride over the second area, by vibrating the second area of the inner wall of the flow passage so that the liquid is successfully discharged from the liquid discharge port.

In the liquid transport head according to the present invention, the oscillation mechanism may include a piezoelectric element which vibrates an outer wall opposed to the second area in the flow direction of the liquid in the flow passage in accordance with application of a voltage.

In the liquid transport head according to the present invention, the second area may be interposed between two of the first areas; and the second area may have such a structure that the liquid easily enters the second area from one of the first areas disposed on a side opposite to the liquid discharge port with respect to a position corresponding to the second area as compared with a case in which the liquid enters the second area from the other of the first areas disposed on a side of the liquid discharge port with respect to the position corresponding to the second area. According to this arrangement, it is possible to suppress the occurrence of any counterflow of the liquid in the individual flow passage.

In the liquid transport head according to the present invention, taking the easiness of the production into consideration, a boundary line, which is formed between the second area and the other first area disposed on the side of the liquid discharge port with respect to the second area, may be composed of a straight line perpendicular to the flow direction of the liquid, and a boundary line, which is formed between the second area and the one first area disposed on the side opposite to the liquid discharge port with respect to the second area, may be a zigzag line.

In the liquid transport head according to the present invention, the individual flow passage may have an atmospheric air communication hole which is formed at a position corresponding to the second area in the flow direction of the liquid. According to this arrangement, it is possible to reliably form a bubble at the position corresponding to the second area. Further, the meniscus fluctuation, which would be otherwise caused by the change in the temperature and the atmospheric pressure, can be suppressed.

In the liquid transport head according to the present invention, the liquid passage-permitting mechanism may include a low liquid repellence member which has a surface having liquid repellence lower than that of the second area, the surface being arranged to oppose to the second area; and a driving mechanism which is capable of displacing the surface of the low liquid repellence member between a position to make contact with the liquid in the flow passage and a position to make separation therefrom. According to this arrangement, when the position of the surface of the low liquid repellence member is the position to make contact with the liquid in the flow passage, the liquid can pass across the position corresponding to the second area. Therefore, the liquid can be discharged from the liquid discharge port.

In the liquid transport head according to the present invention, the driving mechanism may include a piezoelectric element which is deformable in a direction to change a distance between the surface of the low liquid repellence member and the second area in accordance with application of a voltage. According to this arrangement, it is possible to efficiently change the distance between the surface of the low liquid repellence member and the second area.

According to a second aspect of the present invention, there is provided a liquid transport apparatus comprising:

a liquid transport head which has a liquid discharge port;

a pressurizing mechanism which pressurizes a liquid in the liquid transport head in a direction directed toward the liquid discharge port; and a control unit which controls the liquid transport head, wherein the liquid transport head comprises:

a flow passage which includes a first area and a second area formed on an inner wall which makes contact with the liquid, the second area being adjacent to the first area in a flow direction of the liquid and having liquid repellence higher than that of the first area, wherein the liquid, which is pressurized by the pressurizing mechanism, is incapable of passing through the second area to move toward the liquid discharge port, and thus a gas stays in the second area; and a liquid passage-permitting mechanism which selectively permits the pressurized liquid to pass through the second area on the basis of control of the control unit.

According to the second aspect of the present invention, the liquid can be discharged from the liquid discharge ports arranged at a high density, because of the use of the head which can be highly integrated with ease.

In the liquid transport apparatus according to the present invention, a varying or fluctuating pressure may be applied to the liquid in the liquid transport head. By doing so, it is possible to easily perform the switching between the state in which the liquid is discharged and the state in which the liquid is not discharged.

In the liquid transport apparatus according to the present invention, the liquid passage-permitting mechanism may include a first electrode which is formed at a position corresponding to the first area; an insulator which is formed as an inner wall of the flow passage in the second area; and a second electrode which is electrically connected to the insulator; wherein the control unit may be capable of adjusting a time to apply a voltage between the first electrode and the second electrode.

In the liquid transport apparatus according to the present invention, the liquid passage-permitting mechanism may include an oscillation mechanism which vibrates an inner wall of the flow passage at least in the second area; and the control unit may be capable of adjusting a time to vibrate the inner wall of the flow passage.

In the liquid transport apparatus according to the present invention, the liquid passage-permitting mechanism may include a low liquid repellence member which has a surface having liquid repellence lower than that of the second area, the surface being arranged to oppose to the second area; and a driving mechanism which is capable of displacing the surface of the low liquid repellence member between a position to make contact with the liquid in the flow passage and a position to make separation therefrom; wherein the control unit is capable of adjusting a time to retain the low liquid repellence member at the position at which the surface of the low liquid repellence member makes contact with the liquid in the flow passage.

According to the arrangement as described above, it is possible to adjust the liquid volume per one droplet to be discharged from the liquid discharge port.

According to a third aspect of the present invention, there is provided a liquid transport apparatus comprising:

a flow passage which has a first area and an insulative second area which is adjacent to the first area and which has liquid repellence higher than that of the first area; and an electrode which is connected to the second area, wherein a liquid is conductive, and the liquid is permitted to pass through the second area from the first area depending on a voltage applied to the electrode.

The liquid transport apparatus according to the third aspect controls the transport of the conductive liquid by utilizing the electrowetting phenomenon. The apparatus is excellent in the response performance, although the apparatus has the simple structure. Therefore, the apparatus is preferably usable for the way of use such as the ink-jet head. The apparatus may further include another electrode which makes contact with the liquid, wherein a liquid discharge port may be connected to the first area.

DESCRIPTION OF THE PREFERRED EMBODIMENTS

Preferred embodiments of the present invention will be explained below with reference to the drawings.

Figure 1:
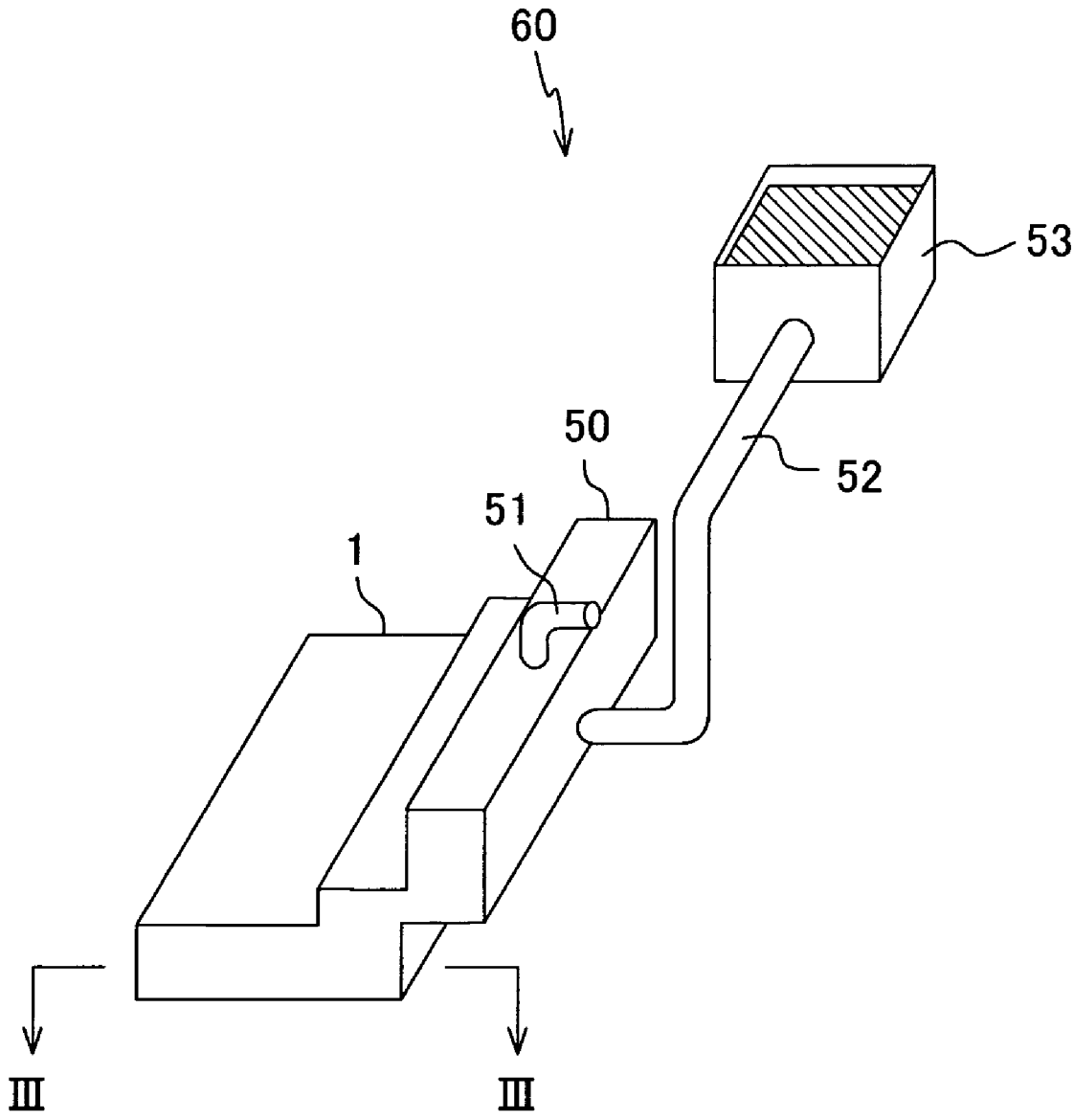
FIG. 1 schematically shows a general arrangement of a printer according to a first embodiment of the present invention.

FIG. 1 schematically shows a general arrangement of a printer 60 according to a first embodiment of the present invention. The printer 60 includes an ink tank 50 which stores the ink supplied from an ink cartridge 53, and a head 1 which discharges the ink onto the printing paper to form an image. The ink cartridge 53 and the ink tank 50 are connected to one another by an ink supply tube 52. An air supply tube 51 is connected to the ink tank 50. In this embodiment, the ink contained in the ink tank is pressurized by a pressurizing mechanism as described later on. The ink tank 50 is directly connected to the head 1. Therefore, the pressure, which is applied to the ink contained in the head 1, is the same as the pressure which is applied to the ink contained in the ink tank 50. The ink, which is used in this embodiment, is an ink having conductivity.

Figure 2:
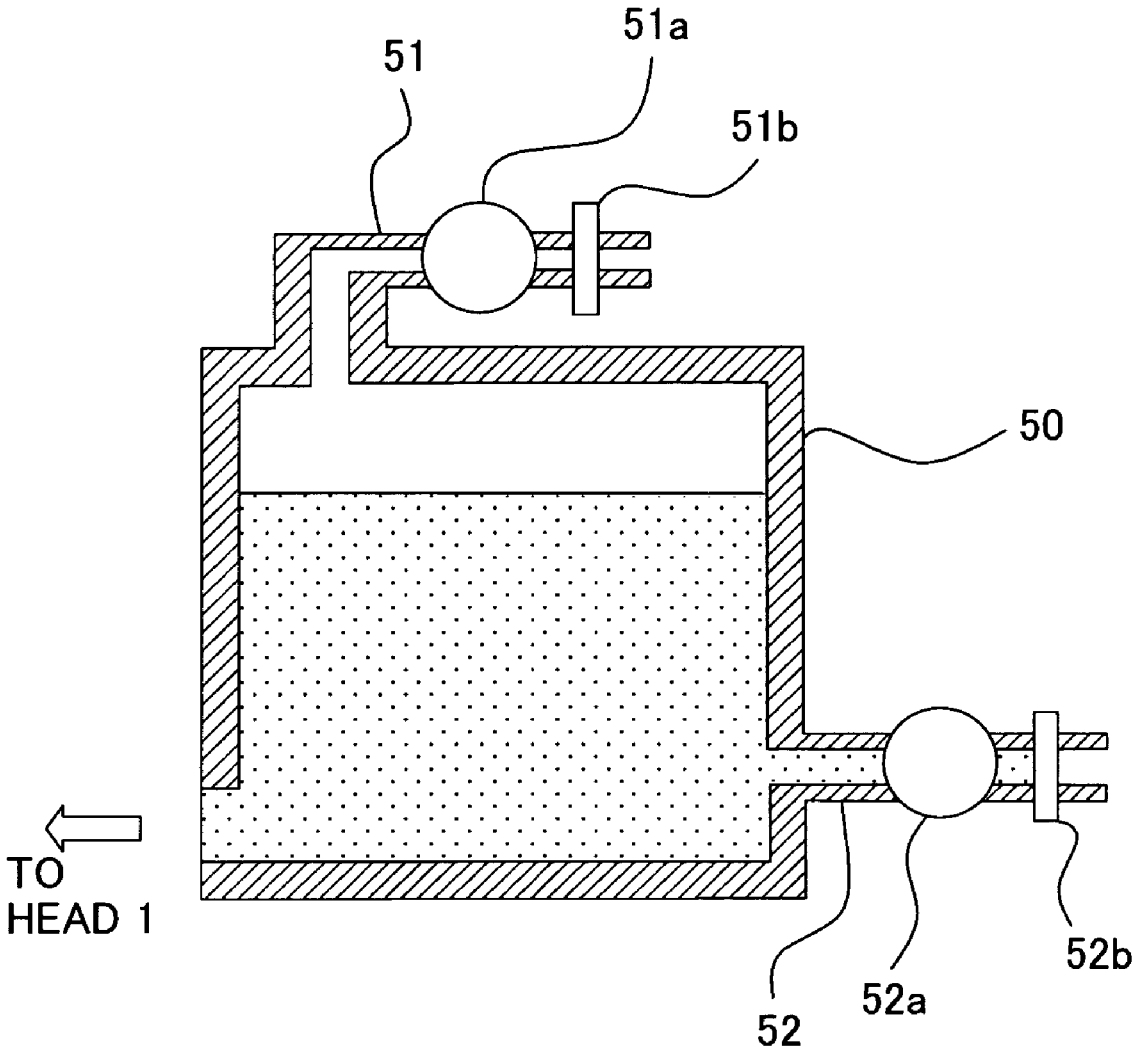
FIG. 2 schematically shows a sectional view illustrating an ink tank shown in FIG. 1.

An explanation will now be made with reference to FIG. 2 about the mechanism for pressurizing the ink contained in the ink tank 50. FIG. 2 schematically shows a sectional view illustrating the ink tank 50. As shown in FIG. 2, the air supply tube 51, which is connected to the ink tank, is provided with a pump 51*a* and a valve 51*b*. The ink supply tube 52 is provided with a pump 52*a* and a valve 52*b*. Therefore, the ink contained in the ink tank 50 can be pressurized by closing the valve 52*b* of the ink supply tube 52, opening the valve 51*b* of the air supply tube 51, and supplying the air to the ink tank 50 by the pump 51*a*. In this procedure, the pump 51*a* finely varies or fluctuates the amount of supply of the air periodically so that the pressurizing force, which is applied to the ink, is varied. When the ink contained in the cartridge 53 is supplied to the ink tank 50, then the valve 51*b* of the air supply tube 51 and the valve 52*b* of the ink supply tube 52 are opened, and the ink is supplied to the ink tank 50 by the pump 52*a*. However, any image is not formed during the supply of the ink to the ink tank 50.

Figure 3:
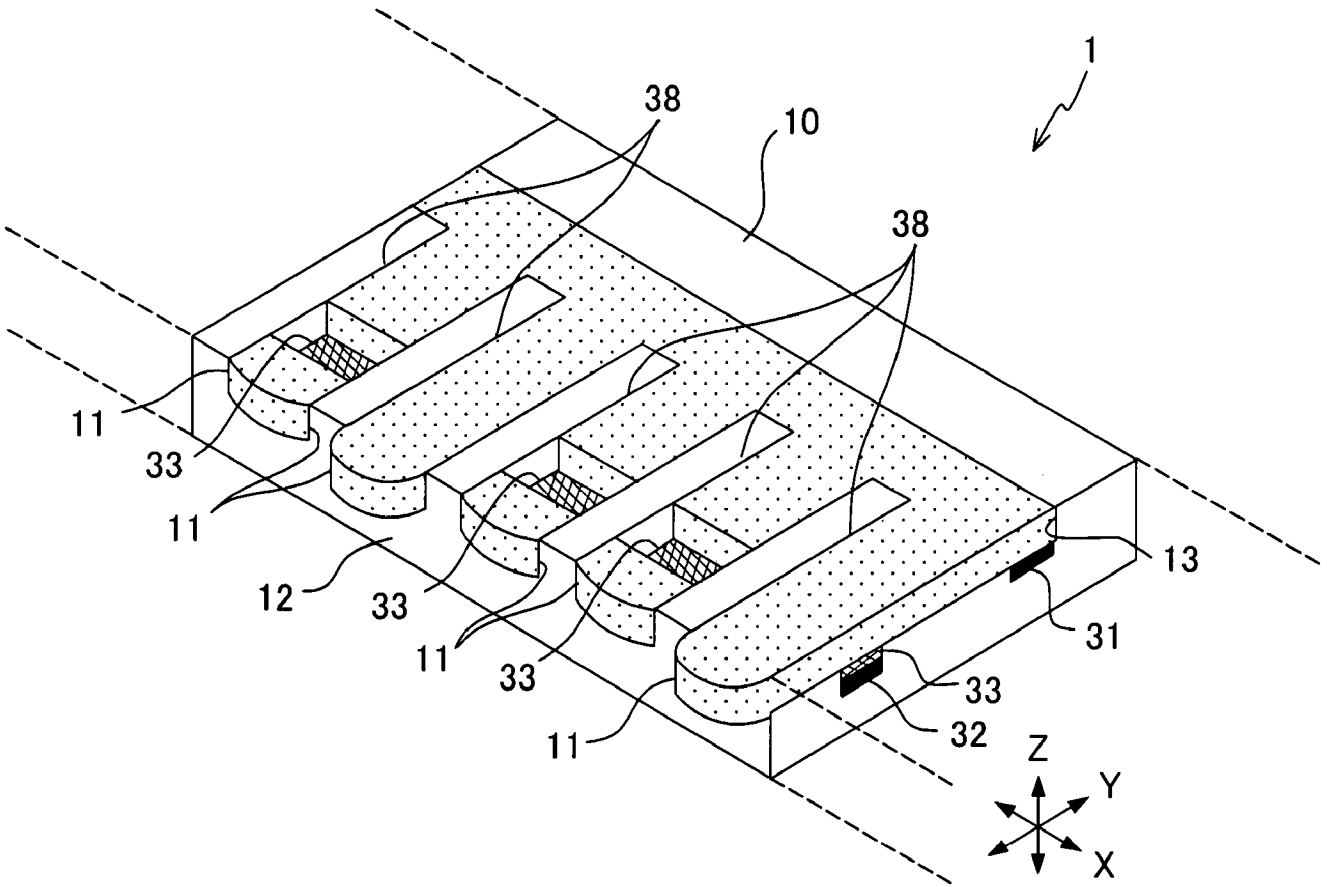
FIG. 3 shows a perspective view illustrating major parts of a head 1 depicted together in cross section taken along a line III-III shown in FIG. 1.
Figure 4:
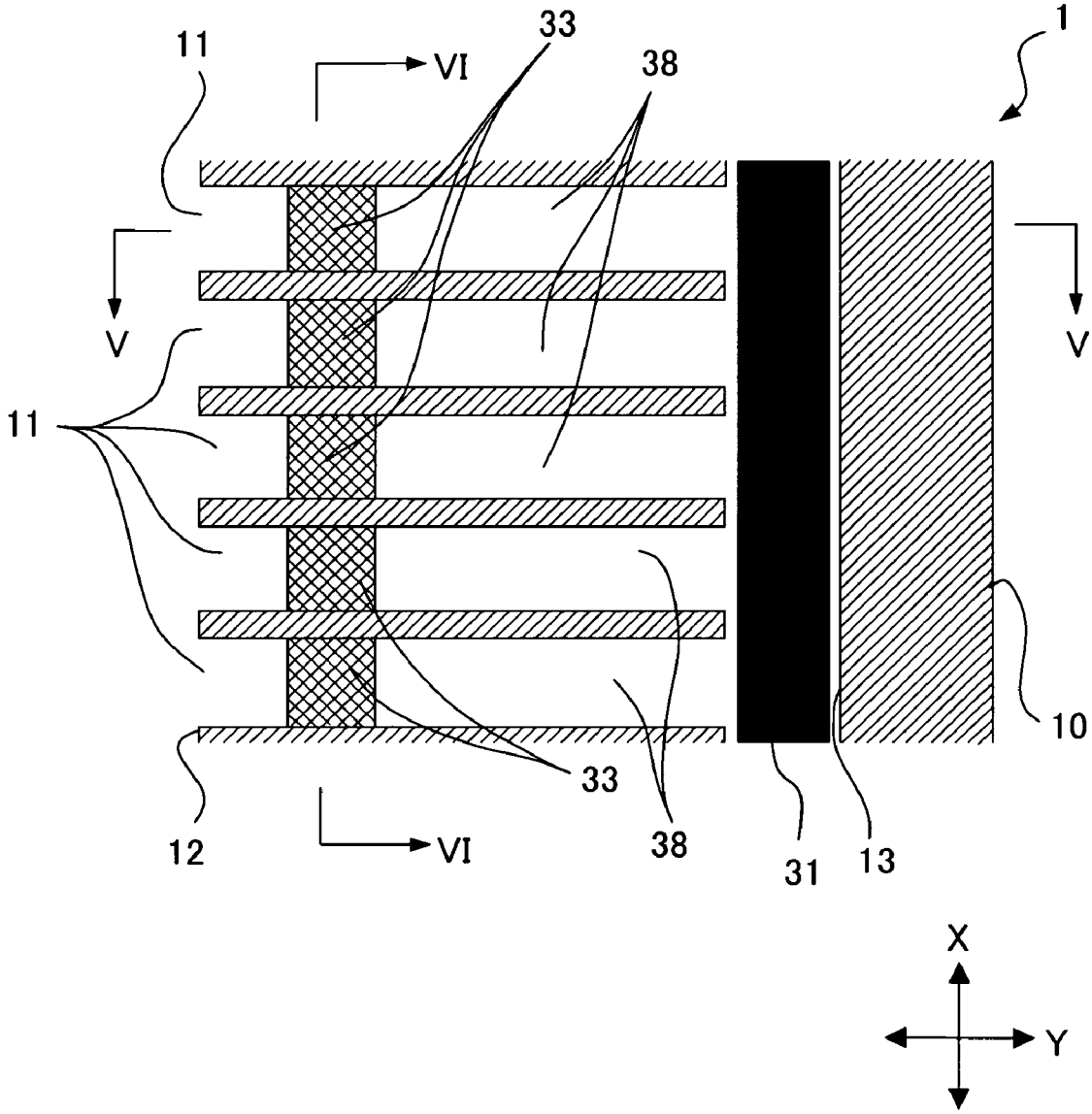
FIG. 4 shows a horizontal sectional view illustrating the head shown in FIG. 3.
Figure 5:
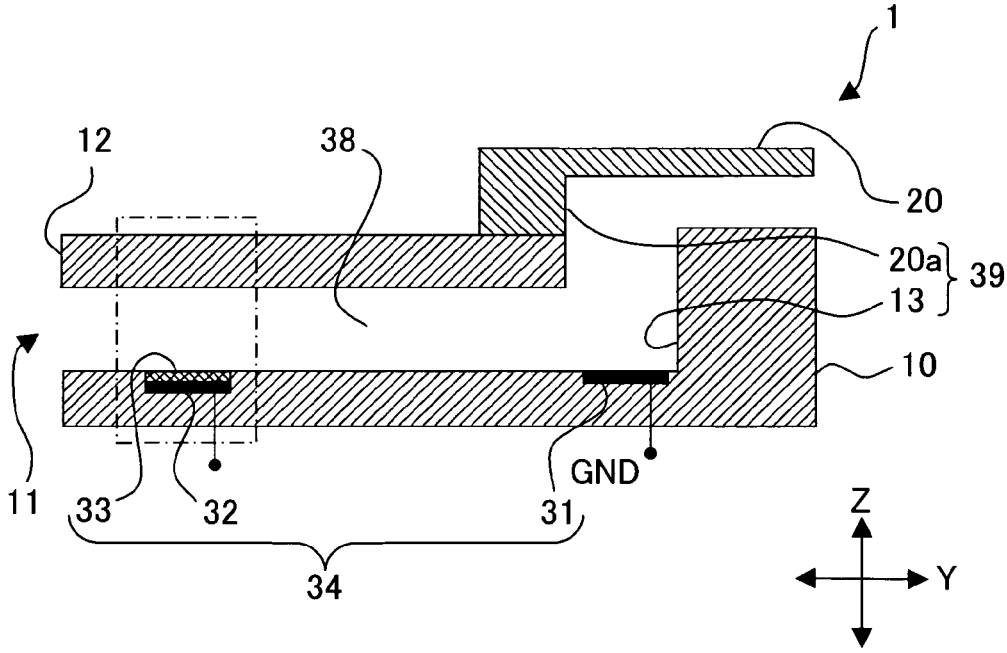
FIG. 5 shows a sectional view illustrating the head taken along a line V-V shown in FIG. 4.
Figure 6:
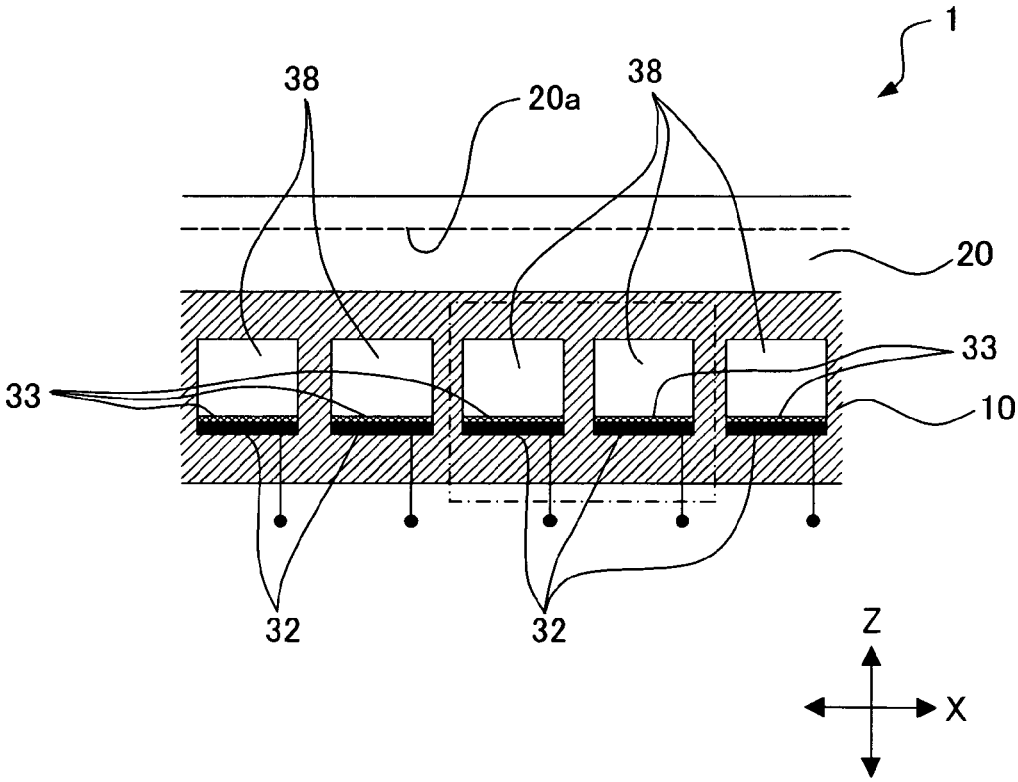
FIG. 6 shows a sectional view illustrating the head taken along a line VI-VI shown in FIG. 4.
Figure 7:
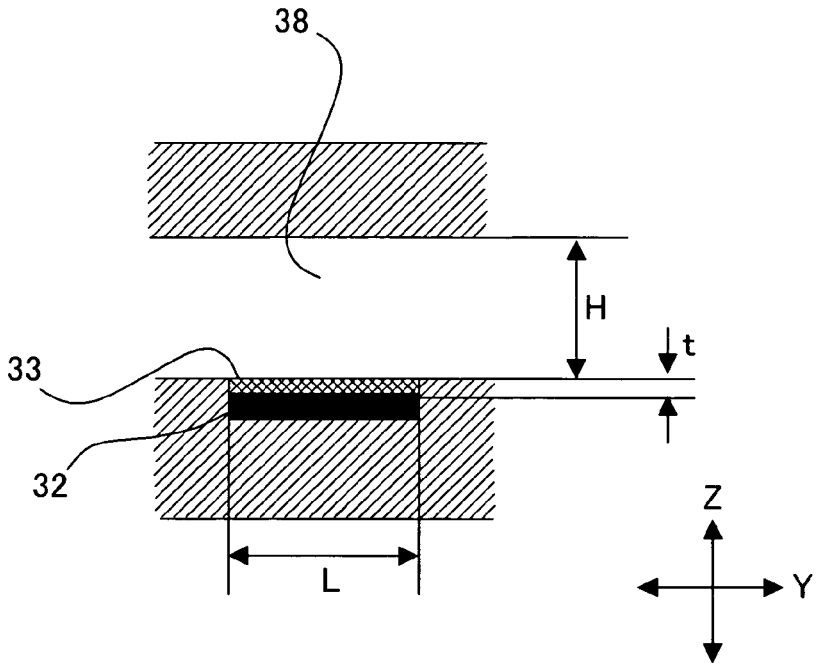
FIG. 7 shows a partial magnified view illustrating the head shown in FIG. 5.
Figure 8:
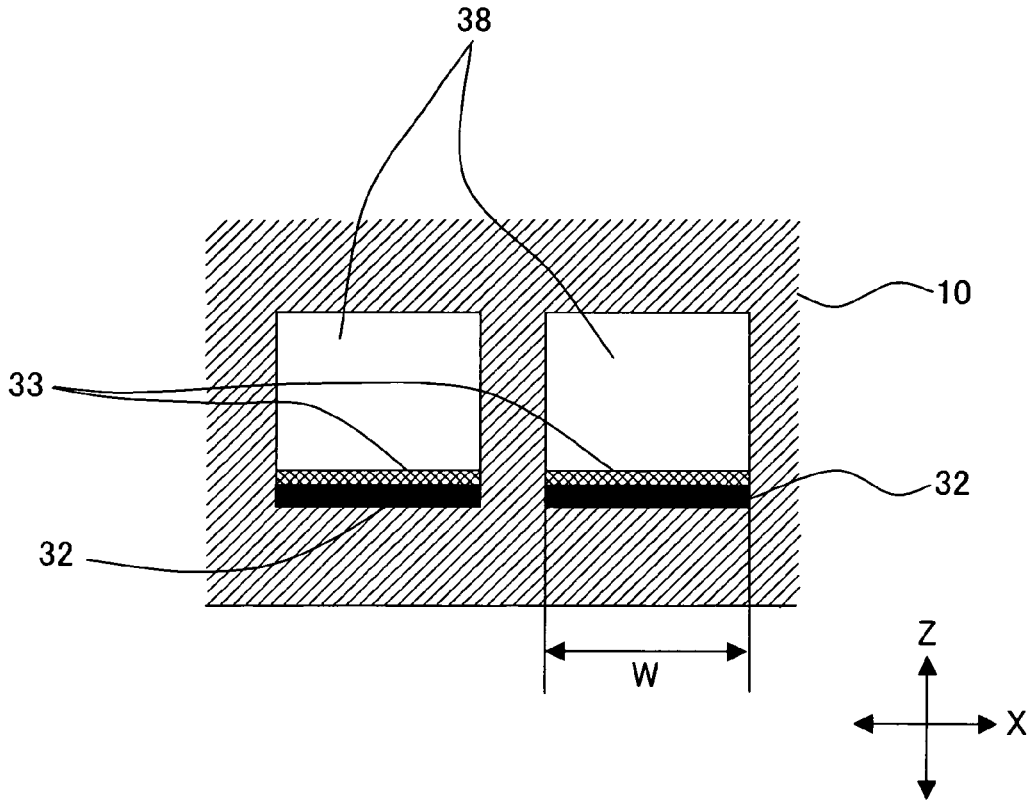
FIG. 8 shows a partial magnified view illustrating the head shown in FIG. 6.

Next, an explanation will be made with reference to FIGS. 3 to 8 about a schematic structure of the head 1. FIG. 3 shows a perspective view illustrating major parts of the head 1 depicted together in cross section taken along a line III-III shown in FIG. 1. FIG. 4 shows a horizontal sectional view illustrating the head 1 shown in FIG. 3. FIG. 5 shows a sectional view illustrating the head 1 taken along a line V-V shown in FIG. 4. FIG. 6 shows a sectional view illustrating the head 1 taken along a line VI-VI shown in FIG. 4. FIG. 7 shows a partial magnified view illustrating a portion of the head 1 surrounded by dashed lines shown in FIG. 5. FIG. 8 shows a partial magnified view illustrating a portion of the head 1 surrounded by dashed lines shown in FIG. 6. In FIGS. 3 to 8, the arrows X, Y, Z, which are perpendicular to one another, indicate the longitudinal direction, the widthwise direction, and the vertical direction of the head 1 according to this embodiment respectively.

As shown in FIGS. 5 and 6, the head 1 is provided with an ink discharge unit 10 and an ink supply unit 20. The ink discharge unit 10 is a substantially rectangular parallelepiped-shaped member, and has a recessed groove 13 which is formed on its upper surface in the longitudinal direction (X direction). A plurality of individual flow passages 38 are formed in the Y direction between the recessed groove 13 and an ink discharge surface 12 (left side surface as viewed on the sheet surface of FIGS. 4 and 5). Therefore, as shown in FIGS. 3 and 4, ink discharge ports 11, which are arranged to form an array in the X direction, are formed on the ink discharge surface 12. As shown in FIG. 6, the individual flow passage 38 has a rectangular cross section. The individual flow passage 38 has a height H (see FIG. 7) of about 24 μm and a width W (see FIG. 8) of about 28 μm.

A common electrode 31 is formed on the bottom surface of the recessed groove 13 in the X direction. Band-shaped individual electrodes 32, which extend in the X direction, are provided on the bottom surface in the vicinity of the ink discharge ports 11 of the individual flow passages 38 respectively. The surface of the individual electrode 32 is covered with a high liquid repellence insulating film 33 which is insulative and which has liquid repellence higher than liquid repellence of the bottom surface of the individual flow passage 38. Therefore, the individual electrode 32 is electrically connected to the high liquid repellence insulating film 33. In this embodiment, the common electrode 31, the individual electrode 32, and the high liquid repellence insulating film 33 function as an ink passage-permitting mechanism 34. The function of the ink passage-permitting mechanism 34 will be described in detail later on.

In this embodiment, the common electrode 31 and the individual electrode 32 are formed, for example, by the sputtering and the vapor deposition of metal materials. The high liquid repellence insulating film 33 is, for example, a parylene film which is formed, for example, by the chemical vapor deposition method. The individual flow passage 38 is formed of, for example, polyimide which has liquid repellence lower than that of the high liquid repellence insulating film 33. In this embodiment, the high liquid repellence insulating film 33 is formed as the bottom surface of the individual flow passage 38. In other words, the high liquid repellence insulating film 33 is formed so that any unevenness or irregularity is not generated on the bottom surface of the individual flow passage 38. Each of the individual electrode 32 and the high liquid repellence insulating film 33 has a length L in the Y direction (see FIG. 7) of about 18 μm, and the high liquid repellence insulating film 33 has a film thickness t (see FIG. 7) of about 0.1 μm.

As shown in FIG. 5, the common electrode 31 is connected to a ground electrode. As shown in FIGS. 5 and 6, the individual electrodes 32 are connected to different signal electrodes respectively. The individual electrode 32 is capable of selectively possessing the ground electric potential and a predetermined electric potential. The predetermined electric potential is established so that the difference in electric potential between the common electrode 31 and the individual electrode 32 has a magnitude required to cause the electrowetting phenomenon as described later on.

The ink supply unit 20 is a substantially rectangular parallelepiped-shaped member, in which the length thereof in the X direction is equal to the length of the ink discharge unit 10 in the X direction, and the length thereof in the Y direction is smaller than the length of the ink discharge unit 10 in the Y direction. A recess 20*a*, which is open downwardly in the X direction, is formed on the lower surface of the ink supply unit 20. As described above, the space, which is formed by the recess 20*a* in the ink supply unit 20, is communicated with the air supply tube 51 and the ink supply tube 52 via the ink tank 50.

The upper surface of the ink discharge unit 10 and the lower surface of the ink supply unit 20 are adhered and fixed to one another so that the space, which is formed by the recessed groove 13 in the ink discharge unit 10, is communicated with the space which is formed by the recess 20*a* in the ink supply unit 20. A common flow passage 39 is formed by the space which is formed by the recessed groove 13 in the ink discharge unit 10 and the space which is formed by the recess 20*a* in the ink supply unit 20 (see FIG. 5). Therefore, the ink contained in the ink tank 50 is supplied to the common flow passage 39 in the head 1 in a state in which the variable or fluctuating pressure is applied, and the ink flows into the individual flow passages 38. As a result, the flow of the ink, which is directed from the recessed groove 13 to the ink discharge port 11, is generated in the individual flow passage 38. As shown in FIG. 5, the common electrode 31 is formed in the common flow passage 39, which is commonly used for the plurality of individual flow passages 38.

The function of the ink passage-permitting mechanism 34 will now be explained. When the pressurized ink is supplied to the head 1, if the individual electrode 32 is allowed to have the ground electric potential, then the ink does not flow across the area (hereinafter simply referred to as "selective passage area") corresponding to the high liquid repellence insulating film 33 as depicted in relation to the 1st, 3rd, and 4th individual flow passages 38 as counted from the left of the sheet surface of FIG. 3, because of the liquid-repelling action of the high liquid repellence insulating film 33, although the ink is pressurized. Therefore, the ink in the individual flow passage 38 is separated or divided into the ink (hereinafter simply referred to as "upstream side ink") disposed on the upstream side in the flow direction of the ink from the selective passage area in the individual flow passage 38 and the ink (hereinafter simply referred to as "downstream side ink") disposed on the downstream side in the flow direction of the ink from the selective passage area. Therefore, the ink is not discharged from the ink discharge port 11.

On the other hand, when the individual electrode 32 is allowed to have the predetermined electric potential, and the voltage is applied between the upstream side ink and the individual electrode 32, then the electrowetting phenomenon is caused as described later on, and the ink flows across the selective passage area as depicted in relation to the 2nd and 5th individual flow passages 38 from the left of the sheet surface of FIG. 3, while overcoming the liquid-repelling action of the high liquid repellence insulating film 33. It is possible to discharge the ink from the ink discharge port 11.

As described above, the ink passage-permitting mechanism 34 is capable of selectively permitting the pressurized ink to pass across the selective passage area in the individual flow passage 38 by allowing the electric potential of the individual electrode 32 of each of the individual flow passages 32 to be the ground electric potential or the predetermined electric potential. Thus, it is possible to selectively discharge the ink from the ink discharge port 11.

As the period of time in which the ink passes across the selective passage area in the individual flow passage 38 is longer, the volume of the ink to be discharged from the ink discharge port 11 is more increased. Therefore, it is possible to change the size of the dot diameter to be formed on the printing paper by the ink discharged from one ink discharge port 11 by regulating the time in which the ink passes across the selective passage area in the individual flow passage 38, i.e., the time in which the voltage is applied between the upstream side ink and the individual electrode 32.

Figure 9:
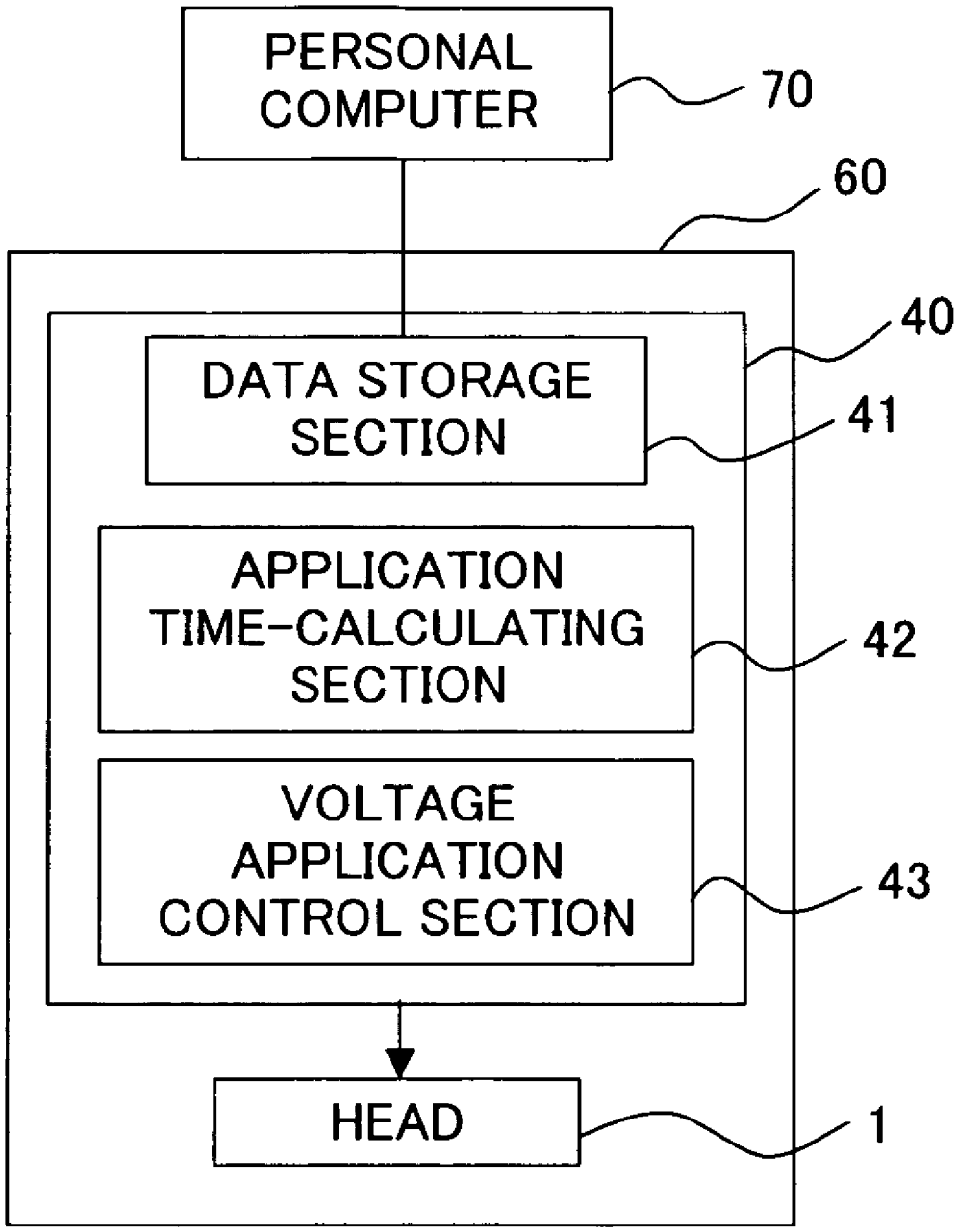
FIG. 9 shows a block diagram illustrating the control of the printer shown in FIG. 1.

Next, an explanation will be made with reference to FIG. 9 about the control of the printer 60. FIG. 9 shows a block diagram in relation to the control of the printer 60. The control of the printer 60 is performed by a controller 40 which is connected to a personal computer 70 and the head 1. The controller 40 includes a data storage section 41, an application time-calculating section 42, and a voltage application control section 43.

The data storage section 41 stores the printing data transmitted from the personal computer 70. The application time-calculating section 42 calculates the time for applying the voltage between the ink and the individual electrode 32 so that the time corresponds to the amount of ink discharge from the ink discharge port 11 to be calculated on the basis of the printing data stored in the data storage section 41. The voltage application control section 43 applies the voltage between the upstream side ink and the individual electrode 32 while allowing the individual electrode 32 to have the predetermined electric potential, on the basis of the voltage application time calculated by the application time-calculating section 42.

The electrowetting phenomenon will now be explained. The electrowetting phenomenon occurs in such a situation that the electrode is insulated from the conductive liquid by the insulating film which is electrically connected to the electrode. In this situation, when the voltage is applied between the electrode and the liquid, the contact angle between the insulating film surface and the liquid is decreased in this phenomenon as compared with a case in which the difference in voltage is absent between the electrode and the liquid. In other words, when the voltage is applied between the electrode and the liquid, the liquid repellence of the insulating film surface is apparently lowered as compared with the case in which the difference in voltage is absent between the electrode and the liquid. It is noted that the voltage to be applied between the electrode and the liquid, which is required to cause the electrowetting phenomenon, has a relatively small magnitude (see U.S. Pat. No. 6,545,815 corresponding to Japanese Patent Application Laid-open No. 2003-177219).

Next, an explanation will be made about the movement of the ink in the individual flow passage 38 as caused when the state, in which the ink is not discharged from the ink discharge port 11, is switched to the state in which the ink is discharged, by using sectional views illustrating the individual flow passage 38 in the vicinity of the selective passage area as shown in FIG. 10. At first, the electric potential of the individual electrode 32 is allowed to have the ground electric potential when the pressurized ink flows into the individual flow passage 38 in a direction indicated by an arrow P. On this condition, the ink flows to arrive at the selective passage area, and the ink flows into the downstream side from the selective passage area, while the high liquid repellence insulating film 33 is not wetted by the ink, but the side surface of the individual flow passage 38 is wetted by the ink. As shown in FIG. 10A, the bubble, which has a size to clog up the individual flow passage 38, stays on the high liquid repellence insulating film 33 in the individual flow passage 38. Therefore, the pressurized ink is incapable of passing across the selective passage area toward the ink discharge port 11. Accordingly, the ink is not discharged from the ink discharge port 11. In this situation, the contact angle θ, which is formed between the ink and the high liquid repellence insulating film 33, is about 100°.

Figure 10A:
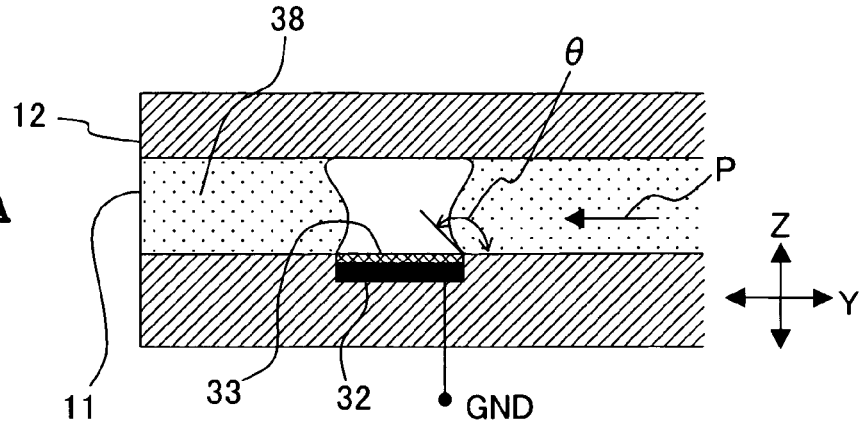
FIGS. 10A to 10D show sectional views illustrating an individual flow passage in the vicinity of a selective passage area of the head shown in FIG. 1.
Figure 10B:
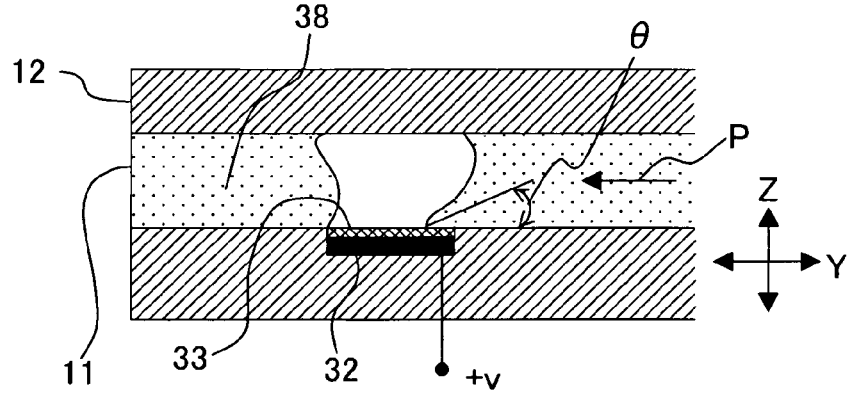
Figure 10C:
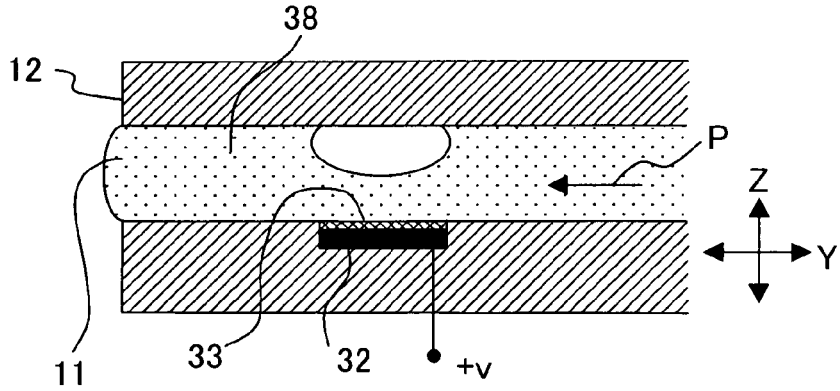

After that, when the voltage is applied between the upstream side ink and the individual electrode 32 while allowing the electric potential of the individual electrode 32 to be the predetermined electric potential by using the voltage application control section 43, then the liquid repellence of the high liquid repellence insulating film 33 is lowered in accordance with the electrowetting phenomenon as shown in FIG. 10B, and the contact angle θ, which is formed between the upstream side ink and the high liquid repellence insulating film 33, is decreased to be about 50°. Therefore, the upstream side ink is spread on the high liquid repellence insulating film 33 while causing the wetting. In this situation, the upstream side ink is pressurized. Therefore, the ink, which has been spread on the high liquid repellence insulating film 33 while causing the wetting, flows toward the downstream side in the flow direction of the ink on the high liquid repellence insulating film 33. As a result, as shown in FIG. 10C, the ink passes across the selective passage area, and the ink is discharged from the ink discharge port 11.

Figure 10D:
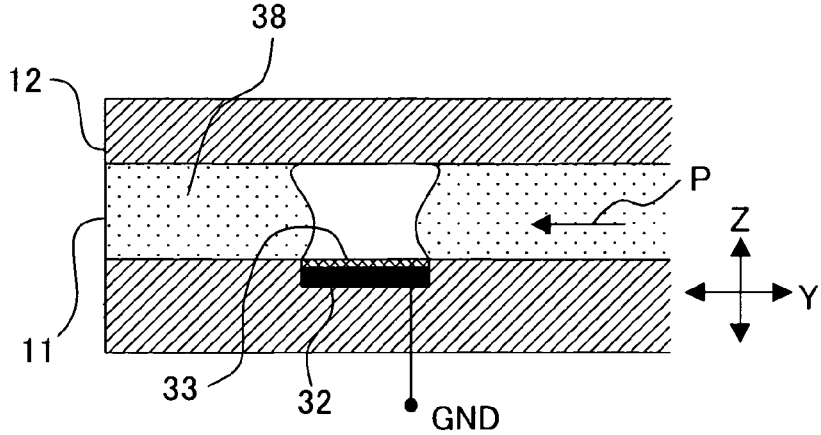

Subsequently, when the electric potential of the individual electrode 32 is allowed to have the ground electric potential by the voltage application control section 43, the high liquid repellence insulating film 33 has the high liquid repellence again. As shown in FIG. 10D, the bubble, which has a size to clog up the individual flow passage 38, stays again at the position on the high liquid repellence insulating film 33 corresponding to the selective passage area. Therefore, the pressurized ink is incapable of passing across the selective passage area toward the ink discharge port 11, and the ink discharge from the ink discharge port 11 is stopped.

The pressure, which is varied or fluctuated in a trembling manner, is applied to the ink. Therefore, the bubble is always vibrated finely or minutely. Therefore, it is easy to effect the switching between the state in which the ink passes across the selective passage area and the state in which the bubble stays in the selective passage area.

As described above, in the head 1 according to the first embodiment, the ink can be selectively discharged from the ink discharge port 11 by effecting the switching between the state in which the ink passes across the selective passage area in the individual flow passage 38 and the state in which the ink does not pass across the selective passage area. As appreciated from the explanation described above, the head 1 is advantageous in that the head 1 is easily highly integrated, the head 1 is miniaturized with ease, and the head 1 successfully has the relatively simple structure as compared with the inkjet head of the piezoelectric type.

The ink passage-permitting mechanism 34 is constructed by the common electrode 31 which is provided on the bottom surface of the recessed groove 13 and which is grounded, the individual electrode 32 which is provided on the bottom surface of the individual flow passage 38 and which is capable of selectively possessing the ground electric potential and the predetermined electric potential, and the high liquid repellence insulating film 33 which covers the surface of the individual electrode 32, which has the insulating performance, and which has the high liquid repellence. As described above, the ink passage-permitting mechanism 34 has no movable member. Therefore, the head 1 hardly undergoes the occurrence of any failure. Further, it is possible to reduce the electric power consumption.

Further, the contact angle between the high liquid repellence insulating film 33 and the ink can be deformed in accordance with the electrowetting phenomenon by applying the voltage between the upstream side ink and the individual electrode 32. In this situation, the pressurized ink passes across the selective passage area in the individual flow passage 38. Therefore, even when a small voltage is applied, it is possible to allow the pressurized ink to pass.

Additionally, the plurality of individual flow passages 38 are arranged so that the ink discharge ports 11 are arranged to form an array in the X direction on the ink discharge surface 12. Therefore, the ink can be simultaneously discharged in a form of straight line from a large number of the ink discharge ports 11.

The common flow passage 39, to which the ink is supplied from the ink tank 50, is commonly connected to the plurality of individual flow passages 38. Therefore, it is possible to simplify the structure to supply the ink to the individual flow passages 38.

Additionally, the ink is discharged from the ink discharge ports 11. Therefore, when the printing paper is arranged closely to the ink discharge surface 12, an image can be formed at a high resolution on the printing paper.

The printer 60 according to the first embodiment uses the head 1 which can be highly integrated with ease. Therefore, it is possible to form an image at a high resolution.

Further, the voltage application control section 43 is provided, which is capable of controlling the time to apply the voltage between the upstream side ink and the individual electrode 32. Therefore, it is possible to adjust the volume of the ink per one droplet to be discharged from the ink discharge port 11. In other words, it is possible to perform the gradational printing at an extremely large number of stages.

Next, a printer according to a second embodiment of the present invention will be explained.

The printer according to this embodiment is constructed differently from the printer 60 according to the first embodiment principally in that an ink passage-permitting mechanism of a head 101 provided for the printer of this embodiment includes an actuator 131 which is capable of vibrating an inner wall of an individual flow passage 138, while the ink passage-permitting mechanism 34 of the head 1 provided for the printer 60 includes the common electrode 31, the individual electrode 32, and the high liquid repellence insulating film 33. The other parts or components are constructed approximately in the same manner as the printer 60 shown in FIG. 1, any detailed explanation of which will be omitted. In the case of the printer 60 of the first embodiment, the conductive ink is used. However, the ink, which is used for the printer of this embodiment, is not necessarily conductive.

Figure 11:
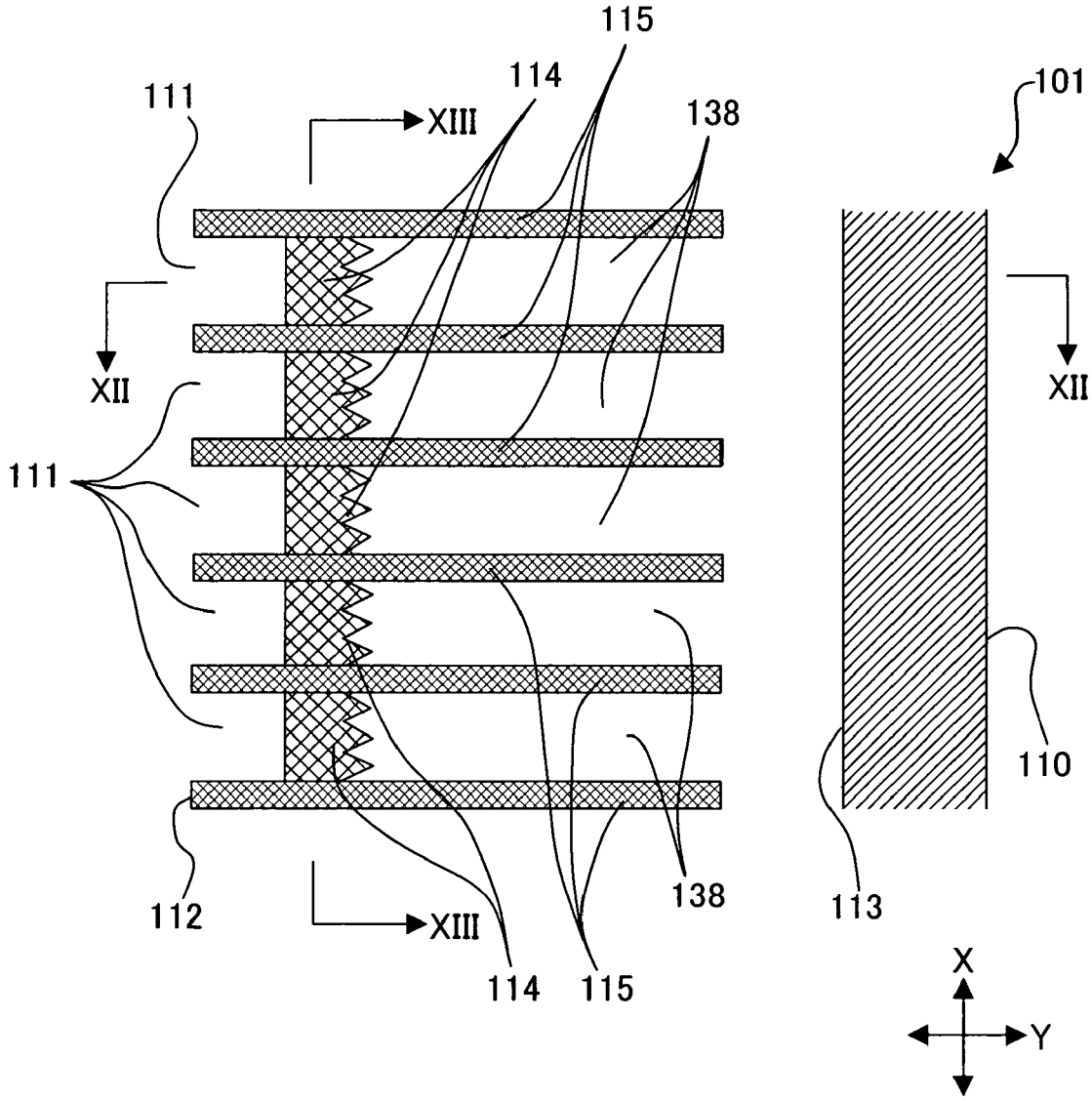
FIG. 11 shows a horizontal sectional view illustrating an ink discharge unit of a head provided for a printer according to a second embodiment of the present invention.
Figure 12:
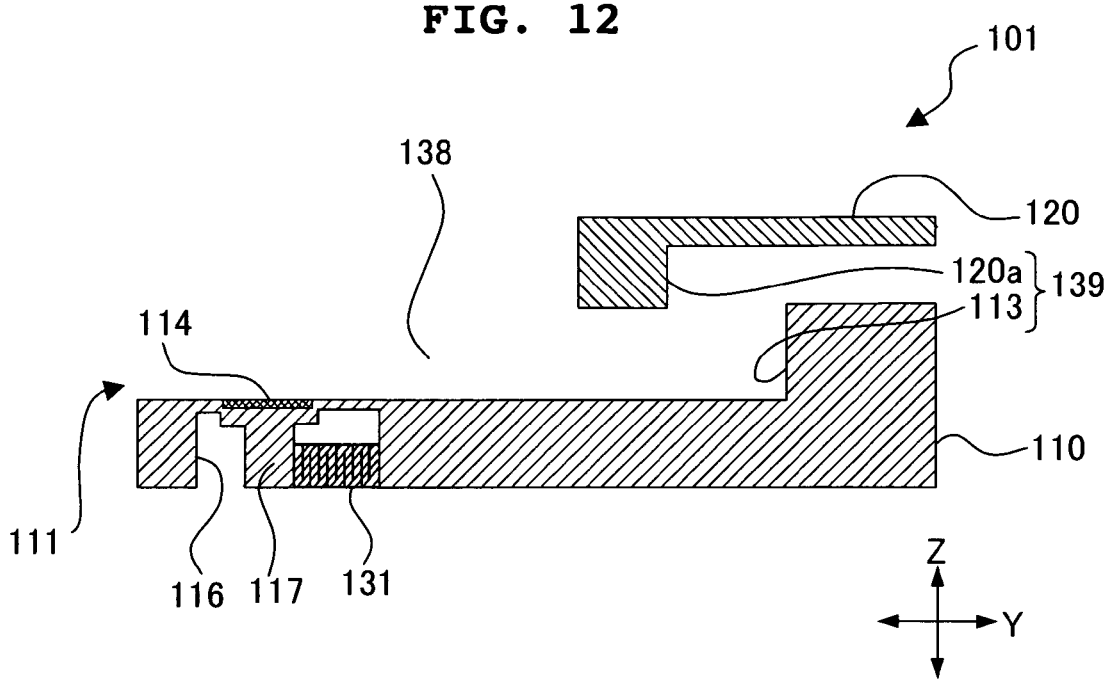
FIG. 12 shows a sectional view taken along a line XII-XII illustrating the head shown in FIG. 11.
Figure 13:
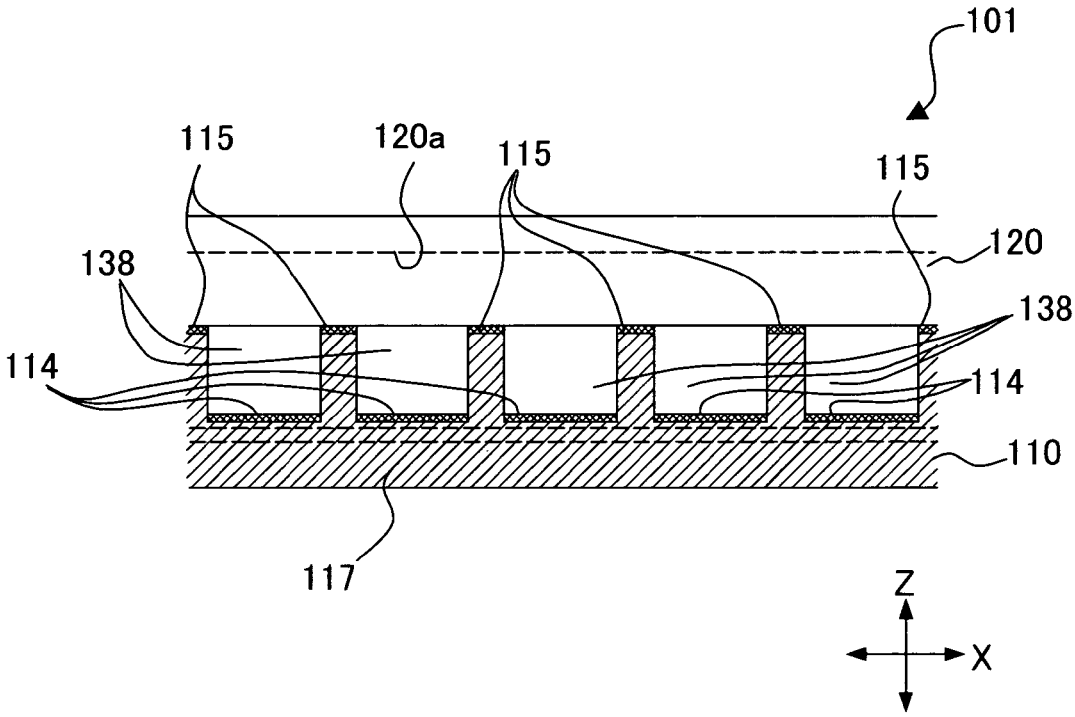
FIG. 13 shows a sectional view taken along a line XIII-XIII illustrating the head shown in FIG. 11.

An explanation will now be made with reference to FIGS. 11 to 13 about the arrangement of the head 101. FIGS. 11 to 13 are drawings corresponding to FIGS. 4 to 6 of the first embodiment respectively.

As shown in FIGS. 12 and 13, the head 101 includes an ink discharge unit 110 and an ink supply unit 120. A plurality of individual flow passages 138 are formed in the ink discharge unit 110. In this embodiment, as shown in FIG. 13, the individual flow passage 138 has a recessed cross section. In other words, in this embodiment, the individual flow passages 138 are open to the atmospheric air. As shown in FIGS. 11 and 13, a high liquid repellence layer 115, which has liquid repellence higher than that of the inner wall of the individual flow passage 138, is formed on each of outer walls which compart the respective individual flow passages 138.

As shown in FIG. 12, a recess 116, which is open downwardly in the X direction, is formed in the vicinity of an ink discharge port 111 on the lower surface of the ink discharge unit 110. A projection 117 is provided on the bottom surface of the recess 116. Further, an actuator 131 is arranged between the projection 117 and the side surface of the recess 116. In this arrangement, the actuator 131 makes vibration in the Y direction when a voltage is applied. Therefore, the actuator 131 is capable of vibrating the projection 117 in the Y direction. In this embodiment, the actuator 131 functions as the ink passage-permitting mechanism. The function of the ink passage-permitting mechanism will be described later on.

Further, a high liquid repellence film 114, which has liquid repellence higher than that of the bottom surface of the individual flow passage 138, is formed in an area of the bottom surface of the individual flow passage 138 opposed to the projection 117. In this embodiment, the area, which corresponds to the high liquid repellence film 114 in the individual flow passage 138, is referred to as "selective passage area". The ink, which is disposed on the upstream side in the flow direction of the ink from the selective passage area in the individual flow passage 138, is simply referred to as "upstream side ink", and the ink, which is disposed on the downstream side in the flow direction of the ink from the selective passage area, is simply referred to as "downstream side ink". In this embodiment, as shown in FIG. 11, the boundary line of the high liquid repellence film 114, which is disposed on the side of the ink discharge port 111, is composed of a straight line which is perpendicular to the flow direction of the ink (straight line parallel to the X direction). On the other hand, the boundary line, which is disposed on the side opposite to the ink discharge port 111, has a zigzag shape which is formed by alternately arranging straight lines having opposite directions of inclination with respect to the straight line perpendicular to the ink flow direction.

When the boundary line having the zigzag shape is formed as described above, the upstream side ink easily passes across the high liquid repellence film 114, when the force, which is applied to the ink toward the downstream side in the flow direction, is increased, for the following reason. That is, it is considered that the critical angle of elevation of the ink meniscus, which is given when the ink meniscus is broken to pass across the high liquid repellence film 114, is constant. Further, the angle of elevation of the ink meniscus is increased to arrive at the critical angle of elevation with ease at portions of the boundary line of the high liquid repellence film 114 disposed most closely to the ink discharge port 111, i.e., at deep portions of the boundary line of the zigzag shape each composed of two parts having the different angles of inclination as compared with the other portions, during the process in which the force, which is applied to the ink toward the downstream side in the flow direction, is progressively increased.

An explanation will now be made about the function of the ink passage-permitting mechanism in this embodiment. When the pressurized ink is supplied to the head 101, if the actuator 131 is not operated, then the ink does not flow across the selective passage area in the individual flow passage 138 owing to the liquid-repelling action of the high liquid repellence film 114 although the ink is pressurized. Therefore, the ink, which is contained in the individual flow passage 138, is divided into the upstream side ink and the downstream side ink. Accordingly, the ink is not discharged from the ink discharge port 111.

On the other hand, when the voltage is applied to the actuator 131 to vibrate the projection 117 in the Y direction, then the vibration of the projection 117 is transmitted, and thus the area on the bottom surface of the individual flow passage 138, which corresponds to the high liquid repellence film 114, is vibrated. In this situation, the acceleration is applied to the upstream side ink. When the acceleration, which is applied to the upstream side ink, is allowed to have a magnitude to sufficiently enable the ink to ride over the high liquid repellence film 114, the ink flows across the selective passage area in the individual flow passage 138 while overcoming the liquid-repelling action of the high liquid repellence film 114. Thus, it is possible to discharge the ink from the ink discharge port 111.

As described above, the ink passage-permitting mechanism is capable of selectively permitting the pressurized ink to pass across the selective passage area in the individual flow passage 138 by selectively vibrating the area corresponding to the high liquid repellence film 114 on the bottom surface of each of the individual flow passages 138 by the actuator 131. Therefore, it is possible to selectively discharge the ink from the ink discharge port 111.

For example, the frequency and the displacement amount in the X direction of the actuator 131 are set so that the acceleration, which sufficiently makes it possible to ride over the high liquid repellence film 114, can be applied to the upstream side ink.

Next, an explanation will be made about the control of the printer according to this embodiment. In this embodiment, the printer is controlled by a controller (not shown) which includes a data storage section, an application time-calculating section, and a voltage application control section in the same manner as in the first embodiment (see FIG. 9). The data storage section functions in the same manner as in the first embodiment. The application time-calculating section calculates the time to apply the voltage to the actuator 131 in order to correspond to the amount of the ink to be discharged from the ink discharge port 111 as calculated on the basis of the printing data stored in the data storage section. The voltage application control section applies the voltage to the actuator 131 on the basis of the voltage application time calculated by the application time-calculating section.

An explanation will now be made about the movement of the ink in the individual flow passage 138 as caused when the state, in which the ink is not discharged from the ink discharge port 111, is switched to the state in which the ink is discharged, by using sectional views illustrating the individual flow passage in the vicinity of the selective passage area as shown in FIG. 14. At first, when the pressurized ink flows into the individual flow passage 138 in a direction indicated by an arrow P, the gas, which has a size to clog up the individual flow passage 138, stays at the position corresponding to the selective passage area in the individual flow passage 138 as shown in FIG. 14A owing to the liquid-repelling action of the high liquid repellence film 114 in the same manner as in the first embodiment. Therefore, the pressurized ink is incapable of passing across the selective passage area toward the ink discharge port 111. Accordingly, the ink is not discharged from the ink discharge port 111.

Figure 14A:
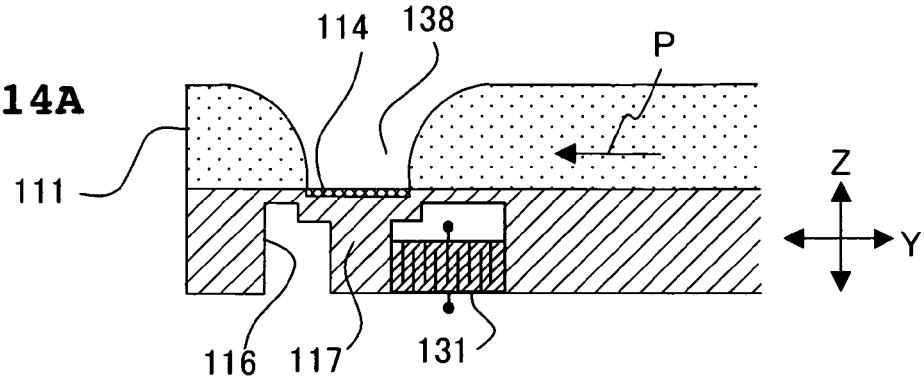
FIGS. 14A to 14D show sectional views illustrating an individual flow passage in the vicinity of a selective passage area of the head shown in FIG. 11.
Figure 14B:
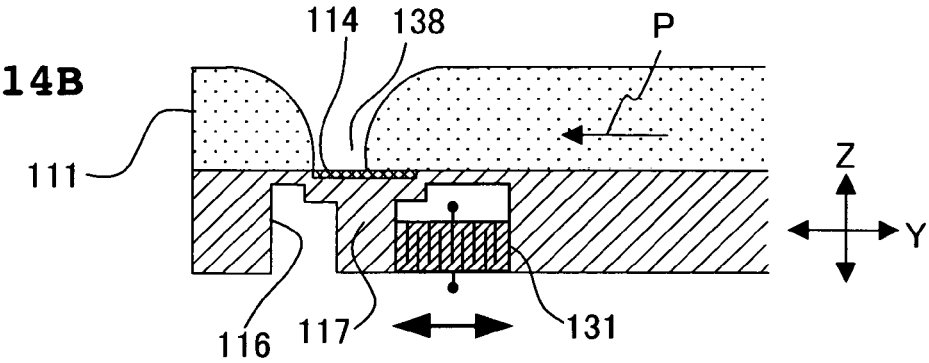
Figure 14C:
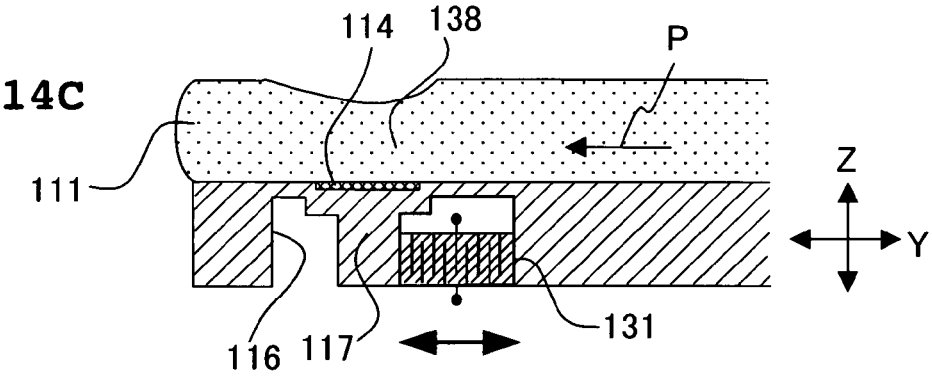

After that, as shown in FIG. 14B, when the voltage is applied to the actuator 131 by the voltage application control section to vibrate the projection 117 in the Y direction, then the vibration of the projection 117 is transmitted, and thus the area on the bottom surface of the individual flow passage 138, which corresponds to the high liquid repellence film 114, is vibrated. Accordingly, the acceleration, which sufficiently makes it possible to ride over the high liquid repellence film 114, is applied to the upstream side ink. Therefore, the ink flows on the high liquid repellence film 114 toward the downstream side in the flow direction. As a result, as shown in FIG. 14C, the ink passes across the selective passage area in the individual flow passage 138, and the ink is discharged from the ink discharge port 111.

Figure 14D:
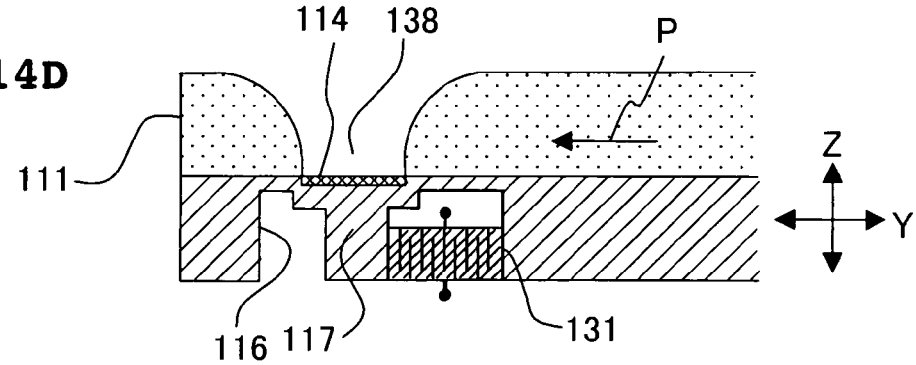

Subsequently, when the voltage application control section completes the application of the voltage to the actuator 131 to stop the vibration of the projection 117, the acceleration is not applied to the upstream side ink. Therefore, as shown in FIG. 14D, the gas, which has a size to clog up the individual flow passage 138, stays again at the position corresponding to the selective passage area in the individual flow passage 138. Therefore, the pressurized ink is incapable of passing across the selective passage area toward the discharge port 111, and the discharge of the ink from the ink discharge port 111 is stopped.

As described above, the head 101 of the second embodiment is easily highly integrated, the head 101 is miniaturized with ease, and the head 101 has the relatively simple structure in the same manner as the head 1 of the first embodiment.

The individual flow passage 138 has the recessed cross section. Therefore, the structure of the ink discharge unit 110 is more simplified, and it is possible to carry out the production at low cost.

Additionally, the high liquid repellence layer 115, which has the liquid repellence higher than that of the inner wall of the individual flow passage 138, is formed on each of the outer walls which compart the respective individual flow passages 138. Therefore, the ink, which is contained in the individual flow passage 138, hardly leaks into the adjoining individual flow passage 138.

The ink passage-permitting mechanism is the actuator 131 which is capable of vibrating the projection 117 formed at the position opposed to the high liquid repellence film 114 in the individual flow passage 138 on the bottom of the recess 116 formed on the lower surface of the ink discharge unit 110. Therefore, the area on the bottom surface of the individual flow passage 138, which corresponds to the high liquid repellence film 114, can be vibrated by vibrating the projection 117. Accordingly, it is possible to apply, to the upstream side ink, the acceleration which sufficiently makes it possible to ride over the high liquid repellence film 114. As a result, the pressurized ink can pass across the selective passage area in the individual flow passage 138, and the ink is discharged from the ink discharge port 111.

Further, the boundary line of the high liquid repellence film 114, which is disposed on the side of the ink discharge port 111, is composed of the straight line which is perpendicular to the flow direction of the ink. The boundary line, which is disposed on the side opposite to the ink discharge port 111, has the zigzag shape which is formed by alternately arranging the straight lines having opposite directions of inclination with respect to the straight line perpendicular to the ink flow direction. Therefore, when the force, which is applied to the ink toward the downstream side in the flow direction, is increased, the upstream side ink passes across the high liquid repellence film 114 with ease.

The printer according to this embodiment has the same advantages as those of the printer according to the first embodiment in relation to the features other than the above.

Next, a printer according to a third embodiment of the present invention will be explained.

The printer according to this embodiment is constructed differently from the printer 60 according to the first embodiment principally in that an ink passage-permitting mechanism 233 of a head 201 provided for the printer of this embodiment includes a low liquid repellence plate 231 and an actuator 232, while the ink passage-permitting mechanism 34 of the head 1 provided for the printer 60 includes the common electrode 31, the individual electrode 32, and the high liquid repellence insulating film 33. The other parts or components are constructed approximately in the same manner as the printer 60 shown in FIG. 1, any detailed explanation of which will be omitted. In the case of the printer 60 of the first embodiment, the conductive ink is used. However, the ink, which is used for the printer of this embodiment, is not necessarily conductive.

Figure 15:
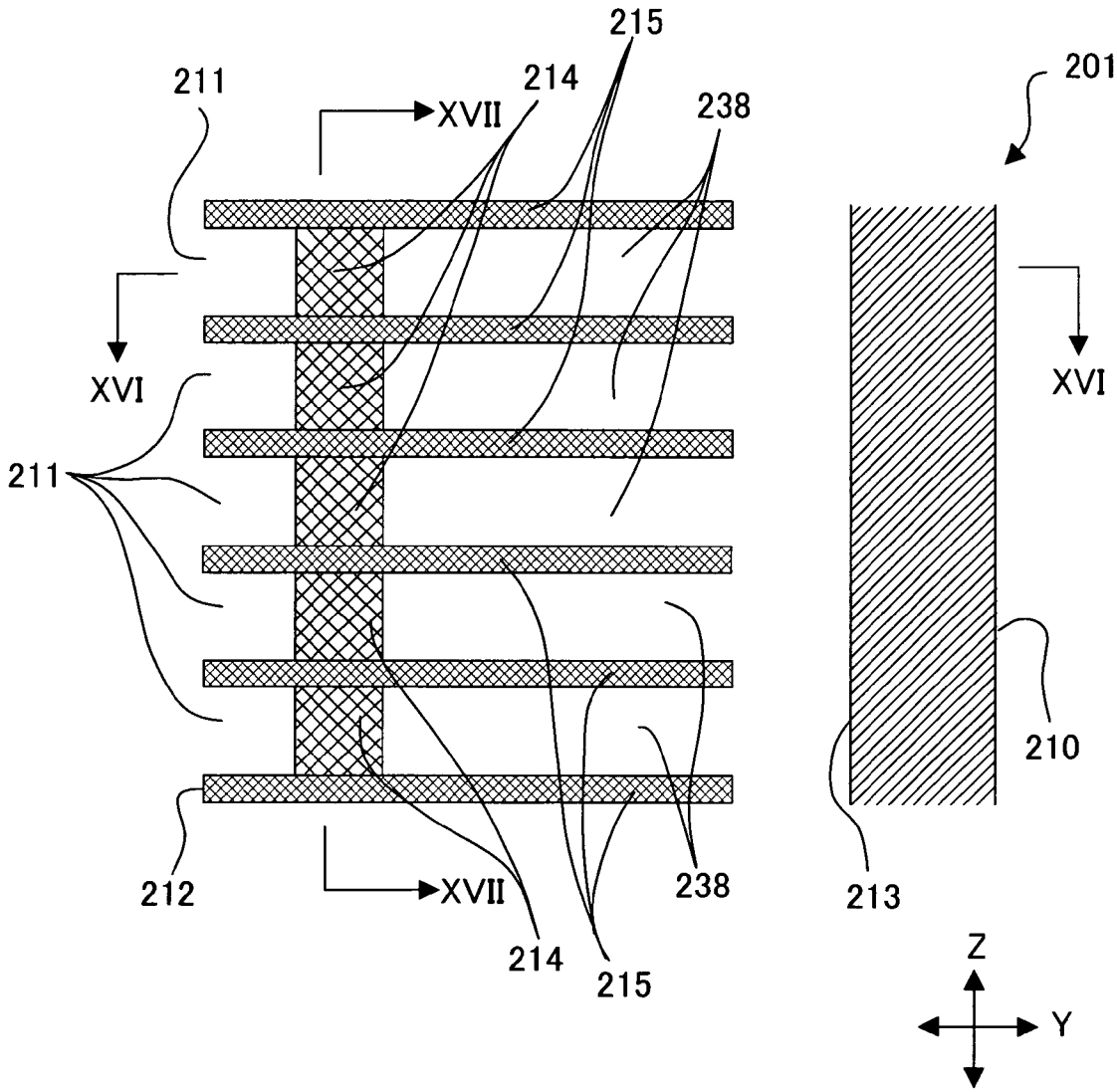
FIG. 15 shows a horizontal sectional view illustrating an ink discharge unit of a head provided for a printer according to a third embodiment of the present invention.
Figure 16:
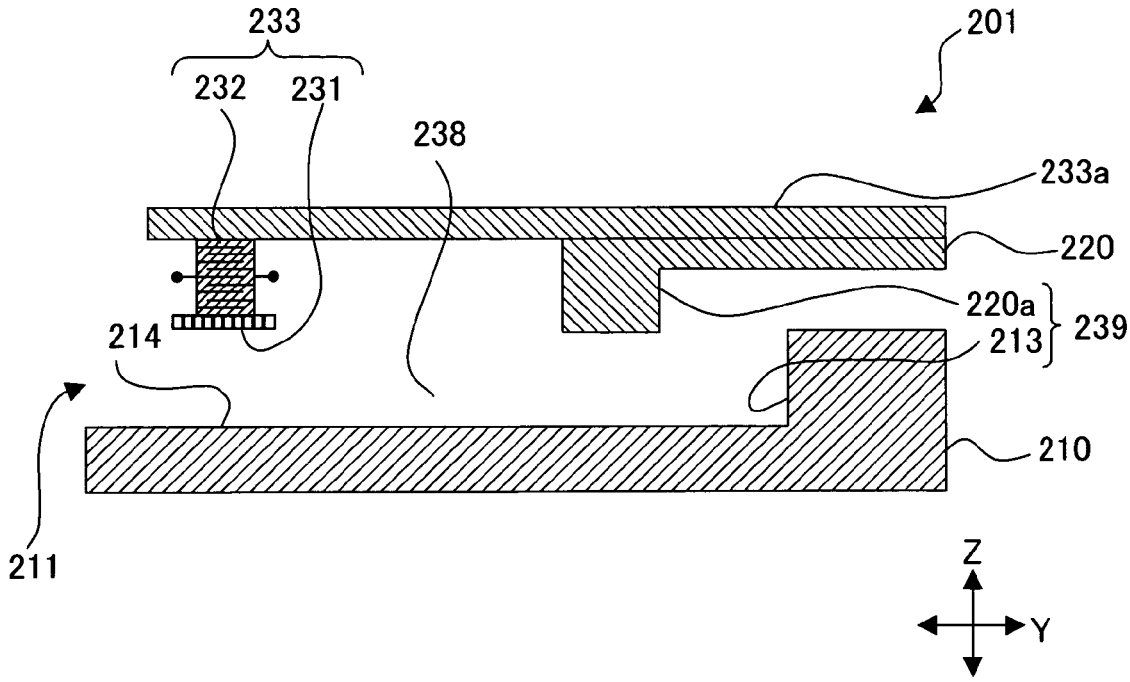
FIG. 16 shows a sectional view taken along a line XVI-XVI illustrating the head shown in FIG. 15.
Figure 17:
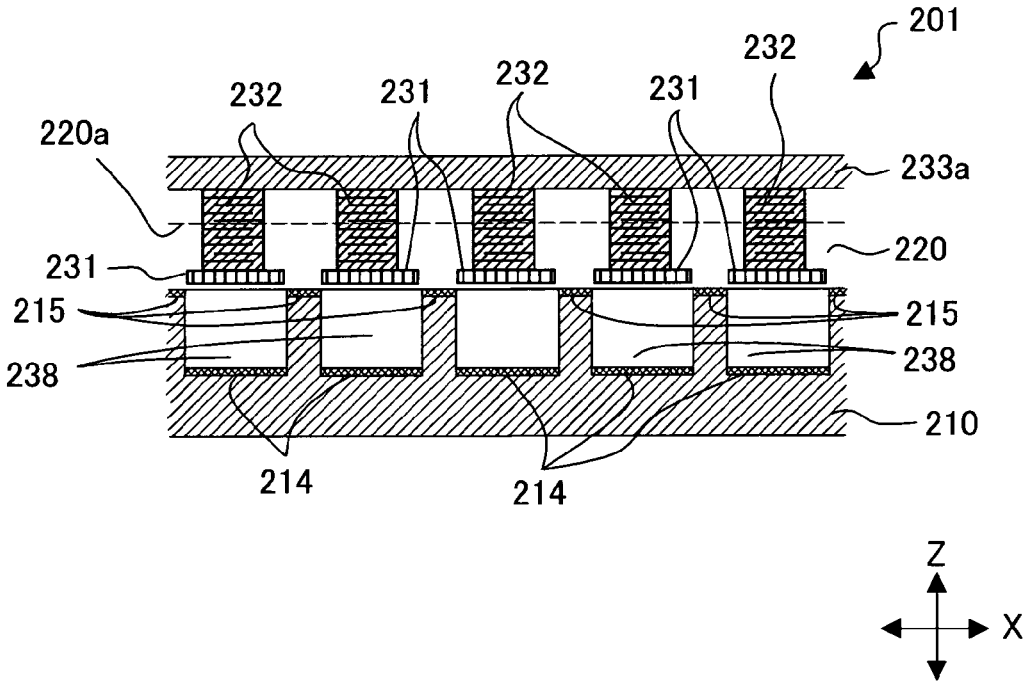
FIG. 17 shows a sectional view taken along a line XVII-XVII illustrating the head shown in FIG. 15.

An explanation will now be made with reference to FIGS. 15 to 17 about the arrangement of the head 201. FIGS. 15 to 17 are drawings corresponding to FIGS. 4 to 6 of the first embodiment respectively.

As shown in FIGS. 16 and 17, the head 201 includes an ink discharge unit 210 and an ink supply unit 220. A plurality of individual flow passages 238 are formed in the ink discharge unit 210. In this embodiment, as shown in FIG. 17, the individual flow passage 238 has a recessed cross section. In other words, in this embodiment, the individual flow passages 238 are open to the atmospheric air. As shown in FIGS. 15 and 17, a high liquid repellence layer 215, which has liquid repellence higher than that of the inner wall of the individual flow passage 238, is formed on each of outer walls which compart the respective individual flow passages 238. Further, a high liquid repellence film 214, which has liquid repellence higher than liquid repellence of the bottom surface of the individual flow passage 238, is formed in the vicinity of the ink discharge port 211 on the bottom surface of the individual flow passage 238.

In this embodiment, the area, which corresponds to the high liquid repellence film 214 in the individual flow passage 238, is referred to as "selective passage area". The ink, which is disposed on the upstream side in the flow direction of the ink from the selective passage area in the individual flow passage 238, is simply referred to as "upstream side ink", and the ink, which is disposed on the downstream side in the flow direction of the ink from the selective passage area, is simply referred to as "downstream side ink".

Further, as shown in FIGS. 16 and 17, a support plate 233*a* is adhered and fixed to the upper surface of the ink supply unit 220. In this embodiment, the support plate 233*a* is a flat plate-shaped member with its length in the X direction being equal to the length of each of the ink discharge unit 210 and the ink supply unit 220 in the X direction. The support plate 233*a* extends in the flow direction of the ink from the upper surface of the ink supply unit 220. The lower surface of the support plate 233*a*, which is disposed in the vicinity of the end in the extending direction, is opposed to the high liquid repellence film 214 in the individual flow passage 238.

The actuators 232, in each of which the length in the Z direction is variable, are provided at portions opposed to the high liquid repellence films 214 of the plurality of individual flow passages 238 on the lower surface of the support plate 233*a* respectively. The low liquid repellence plate 231, which has low liquid repellence, is attached to the surface of the actuator 232 on the side opposite to the surface supported by the support plate 233*a*. Therefore, the lower surface of the low liquid repellence plate 231 is opposed to the high liquid repellence film 214. In this embodiment, the low liquid repellence plate 231 is rectangular with its length in the Y direction being longer than the length of the high liquid repellence film 214 in the Y direction. When the voltage is not applied, the actuator 232 supports the low liquid repellence plate 231 at a position separated from the ink in the individual flow passage 238. When the voltage is applied, then the length of the actuator 232 is increased, and it is possible to displace the low liquid repellence plate 231 to a position to make contact with the ink in the individual flow passage 238. In this embodiment, the low liquid repellence plate 231 and the actuator 232 function as the ink passage-permitting mechanism 233 (see FIG. 16) as described later on.

An explanation will now be made about the function of the ink passage-permitting mechanism 233 of this embodiment. When the pressurized ink is supplied to the head 201, if the voltage is not applied to the actuator 232, then the ink does not flow across the selective passage area in the individual flow passage 238 owing to the liquid-repelling action of the high liquid repellence film 214 although the ink is pressurized. Therefore, the ink, which is contained in the individual flow passage 238, is divided into the upstream side ink and the downstream side ink. Accordingly, the ink is not discharged from the ink discharge port 211.

On the other hand, when the voltage is applied to the actuator 232, and the low liquid repellence plate 231 is displaced downwardly until the low liquid repellence plate 231 makes contact with the upstream side ink and the downstream side ink in the individual flow passage 238, then the ink is spread on the surface of the low liquid repellence plate 213 while causing the wetting. The pressurized in passes across the selective passage area along the surface of the low liquid repellence plate 213 toward the ink discharge port 211. Thus, the ink is discharged from the ink discharge port 211.

As described above, the ink passage-permitting mechanism 233 is capable of selectively permitting the pressurized ink to pass across the selective passage area in the individual flow passage 238 by allowing the ink contained in each of the individual flow passages 238 to selectively make contact with the low liquid repellence plate 231 supported opposingly to the high liquid repellence film 214 in each of the individual flow passages 238. Therefore, it is possible to selectively discharge the ink from the ink discharge port 211.

Next, an explanation will be made about the control of the printer according to this embodiment. In this embodiment, the printer is controlled by a controller (not shown) which includes a data storage section, an application time-calculating section, and a voltage application control section in the same manner as in the first embodiment. The data storage section functions in the same manner as in the first embodiment. The application time-calculating section calculates the time to apply the voltage to the actuator 232 in order to correspond to the amount of the ink to be discharged from the ink discharge port 211 as calculated on the basis of the printing data stored in the data storage section. The voltage application control section applies the voltage to the actuator 232 on the basis of the voltage application time calculated by the application time-calculating section.

Figure 18A:
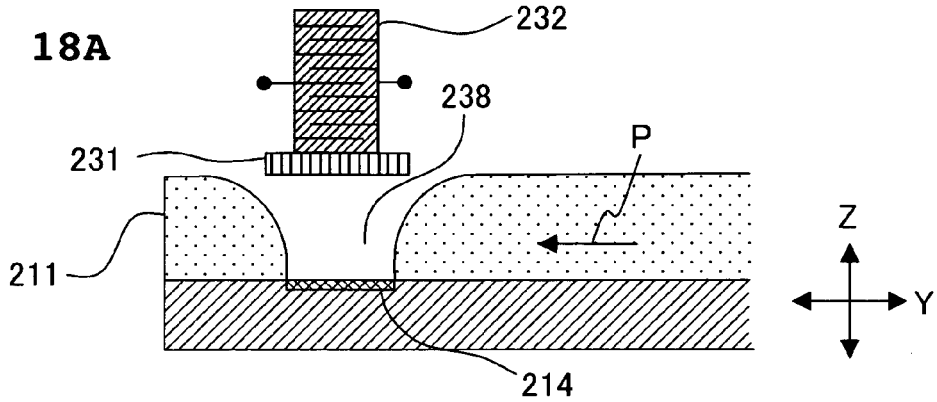
FIGS. 18A to 18D show sectional views illustrating an individual flow passage in the vicinity of a selective passage area of the head shown in FIG. 15.

An explanation will now be made about the movement of the ink in the individual flow passage 238 as caused when the state, in which the ink is not discharged from the ink discharge port 211, is switched to the state in which the ink is discharged with reference to FIG. 18 (FIGS. 18A to 18D). FIG. 18 shows the movement of the ink in the individual flow passage 238. At first, when the ink flows into the individual flow passage 238 in a direction indicated by an arrow P, the gas, which has a size to clog up the individual flow passage 238, stays at the position on the high liquid repellence film 214 corresponding to the selective passage area in the individual flow passage 238 as shown in FIG. 18A. Therefore, the pressurized ink is incapable of passing across the selective passage area toward the ink discharge port 211. Accordingly, the ink is not discharged from the ink discharge port 211.

Figure 18B:
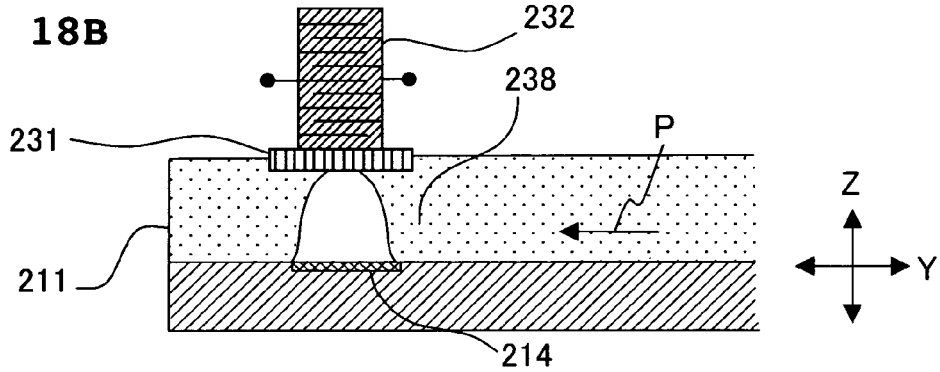
Figure 18C:
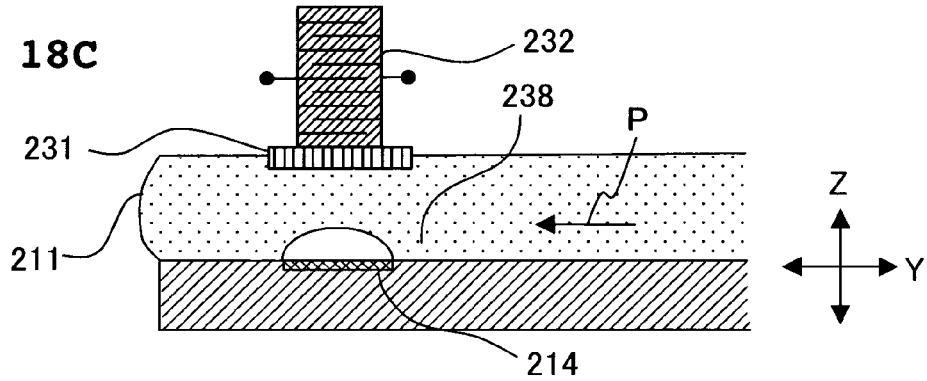

After that, the voltage is applied to the actuator 232 by the voltage application control section to displace the low liquid repellence plate 231 downwardly until the low liquid repellence plate 231 makes contact with the upstream side ink and the downstream stage ink in the individual flow passage 238. In this situation, as shown in FIG. 18B, the ink is spread on the surface of the low liquid repellence plate 231 while causing the wetting. Further, in this situation, the upstream side ink is pressurized. Therefore, the upstream side ink, which has been spread on the surface of the low liquid repellence plate 231 while causing the wetting, flows along the surface of the low liquid repellence plate 231 toward the downstream side in the flow direction. As a result, as shown in FIG. 18C, the ink passes across the selective passage area, and the ink is discharged from the ink discharge port 211.

Figure 18D:
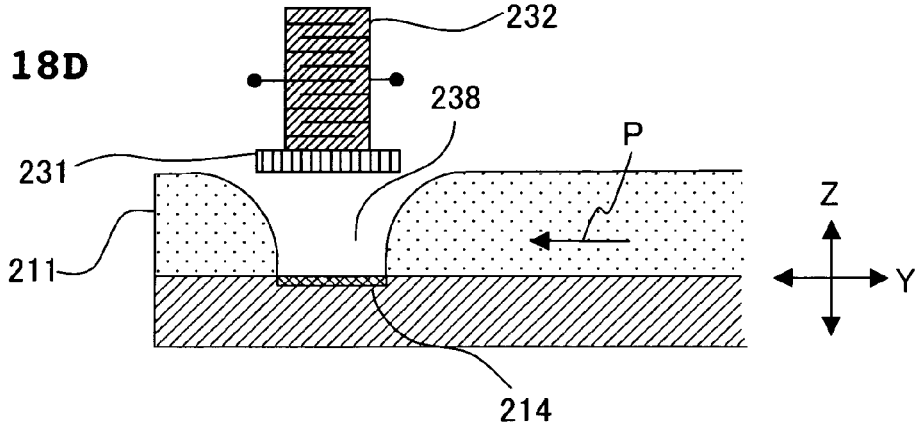

Subsequently, when the voltage application control section completes the application of the voltage to the actuator 232, then the low liquid repellence plate 231 is displaced upwardly, and the low liquid repellence plate 231 makes no contact with the ink. Therefore, as shown in FIG. 18D, the gas, which has a size to clog up the individual flow passage 238, stays again at the position on the high liquid repellence film 214 corresponding to the selective passage area. Therefore, the pressurized ink is incapable of passing across the selective passage area in the individual flow passage 238 toward the discharge port 211, and the discharge of the ink from the ink discharge port 211 is stopped.

As described above, the head 201 of the third embodiment is easily highly integrated, the head 201 is miniaturized with ease, and the head 201 has the relatively simple structure in the same manner as the head 1 of the first embodiment and the head 101 of the second embodiment.

The ink passage-permitting mechanism includes the low liquid repellence plate 231 which is supported to oppose to the high liquid repellence film 214 in the individual flow passage 238, and the actuator 232 which is capable of displacing the low liquid repellence plate 231 in the vertical direction. Therefore, the low liquid repellence plate 231 can be displaced downwardly to make contact with the upstream side ink and the downstream side ink. Accordingly, the ink is spread on the surface of the low liquid repellence plate 231 while causing the wetting. As a result, the pressurized ink can pass across the area corresponding to the high liquid repellence film 214 in the individual flow passage 238. Thus, the ink is discharged from the ink discharge port 211.

The printer according to this embodiment has the same advantages as those of the printer according to the first embodiment in relation to the features other than the above.

The preferred embodiments of the present invention have been explained above. However, the present invention is not limited to the embodiments described above, which can be variously changed and designed within the scope defined in claims.

Figure 19:
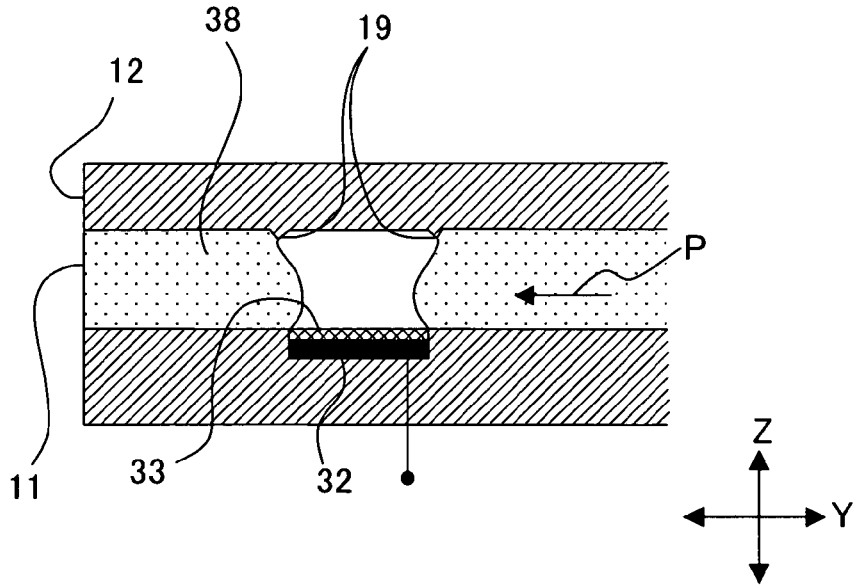
FIG. 19 shows a vertical sectional view illustrating an individual flow passage taken in a flow direction of an ink according to a first modified embodiment of the head shown in FIG. 1.

For example, a first modified embodiment in relation to the first embodiment is shown in FIG. 19. FIG. 19 shows a vertical sectional view illustrating the individual flow passage 38 taken along the flow direction of the ink. Bumps 19 are formed at positions opposed to the both ends of the high liquid repellence insulating film 33 in the Y direction on the upper surface in the individual flow passage 38 according to this modified embodiment. Therefore, in this modified embodiment, when the voltage is not applied between the upstream side ink and the individual electrode 32, the bubble, which stays in the selective passage area in the individual flow passage 38, hardly moves. Therefore, the stability of the meniscus position is improved.

Figure 20:
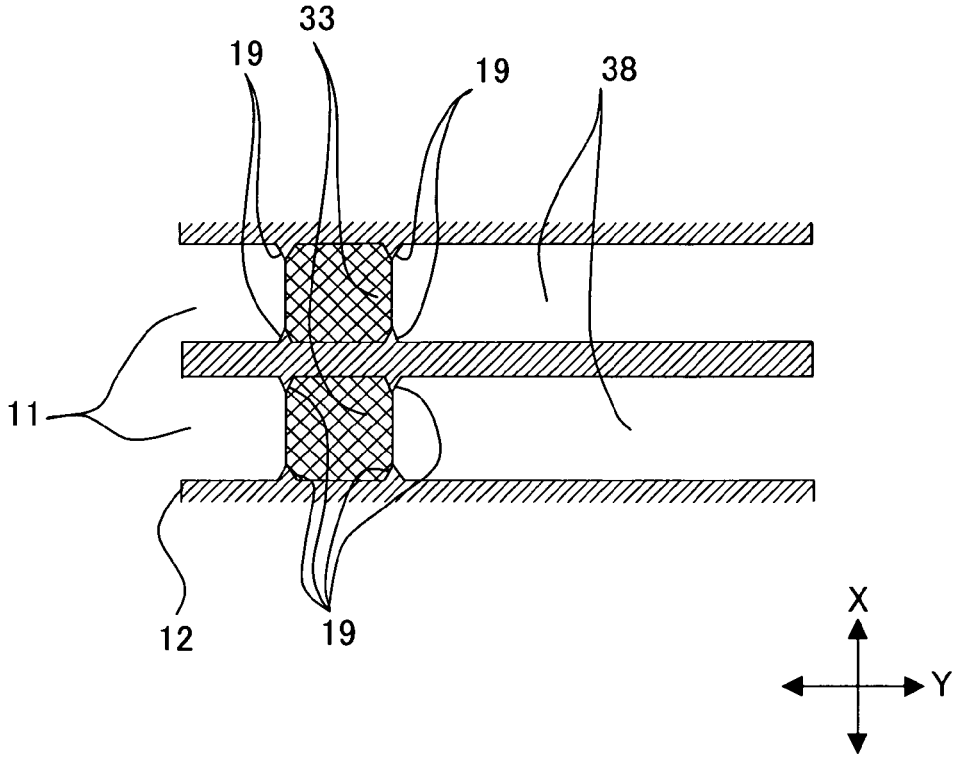
FIG. 20 shows a partial horizontal sectional view illustrating an individual flow passage according to a modified embodiment of the head shown in FIG. 19.

The surface, on which the bumps 19 are formed, is not limited to the upper surface in the individual flow passage 38. As shown in FIG. 20 which is a partial horizontal sectional view of the individual flow passages 38, bumps 19 may be formed at positions corresponding to the both ends of the high liquid repellence insulating film 33 in the Y direction on the both side surfaces in the individual flow passage 38.

The modified embodiment described above has been explained in relation to the case in which the bumps 19 are formed in the individual flow passage 38 of the head 1 of the first embodiment. Similarly, bumps may be also formed in the individual flow passage 138 of the second embodiment in the same manner as described above. Bumps may be also formed in the individual flow passage 238 of the third embodiment.

Figure 21:
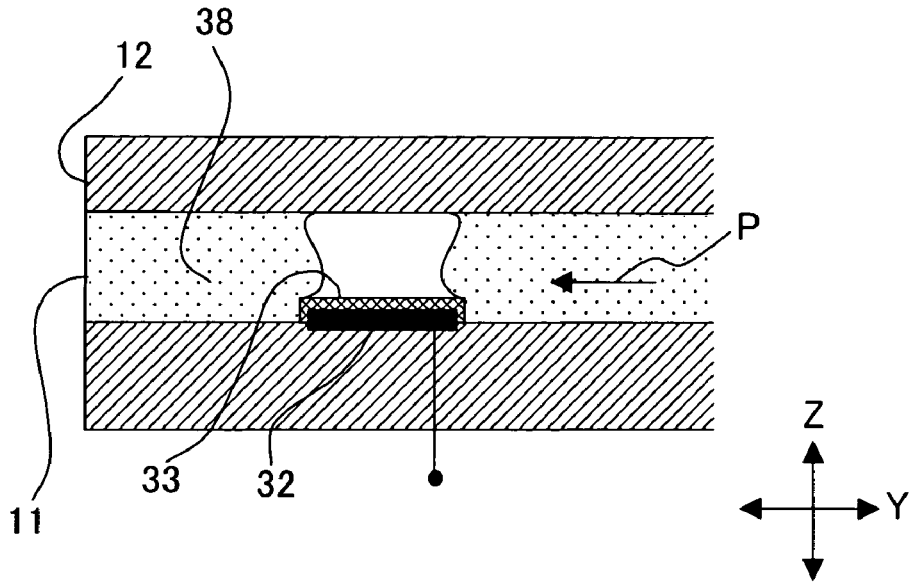
FIG. 21 shows a vertical sectional view illustrating an individual flow passage taken in a flow direction of an ink according to a second modified embodiment of the head shown in FIG. 1.

Further, a second modified embodiment in relation to the first embodiment is shown in FIG. 21. FIG. 21 shows a vertical sectional view of the individual flow passage 38 taken in the flow direction of the ink. In the first embodiment, the high liquid repellence insulating film 33 is formed so that no unevenness is formed on the bottom surface of the individual flow passage 38. However, the individual electrode 32 is formed to protrude from the bottom surface of the individual flow passage 38 on the bottom surface of the individual flow passage 38 according to this modified embodiment. The high liquid repellence insulating film 33 is formed to cover the portion of the individual electrode 32 which protrudes from the bottom surface of the individual flow passage 38. Therefore, the area of the bottom surface of the individual flow passage 38, in which the high liquid repellence insulating film 33 is formed, protrudes as compared with the surroundings on the bottom surface of the individual flow passage 38. Accordingly, in this modified embodiment, the bubble, which stays in the selective passage area in the individual flow passage 38, hardly moves when the ink is shut off or interrupted. As a result, the stability of the meniscus position is improved.

Figure 22:
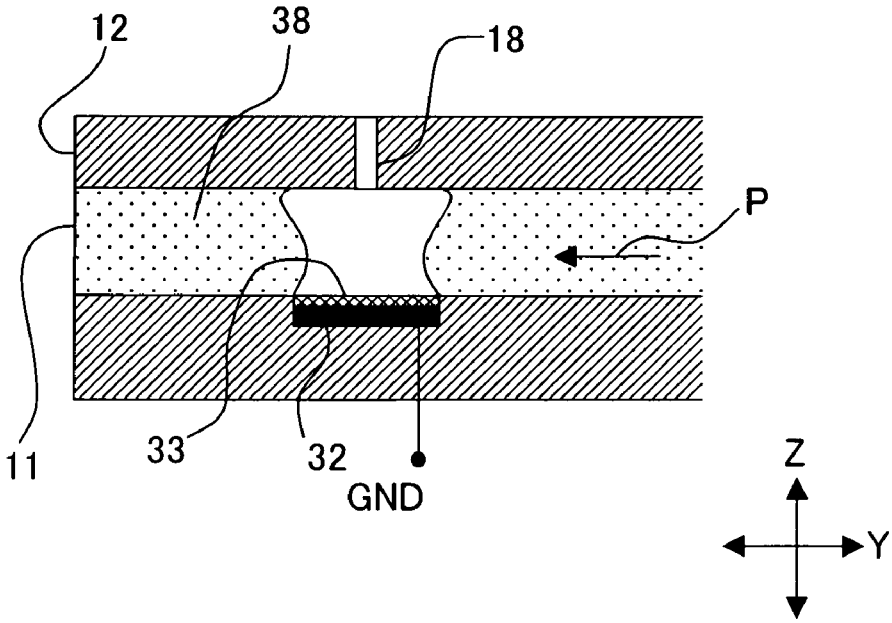
FIG. 22 shows a vertical sectional view illustrating an individual flow passage taken in a flow direction of an ink according to a third modified embodiment of the head shown in FIG. 1.

Additionally, a third modified embodiment in relation to the first embodiment is shown in FIG. 22. FIG. 22 shows a vertical sectional view of the individual flow passage 38 taken in the flow direction of the ink. A hole 18, which is communicated with the atmospheric air, is formed at a position opposed to the high liquid repellence insulating film 33, through the upper surface of the individual flow passage 38 according to this modified embodiment. Therefore, in this modified embodiment, it is possible to reliably form the bubble in the selective passage area in the individual flow passage 38. Further, it is possible to suppress the fluctuation of the meniscus which would be otherwise caused by the change in the temperature or the atmospheric pressure.

Figure 23:
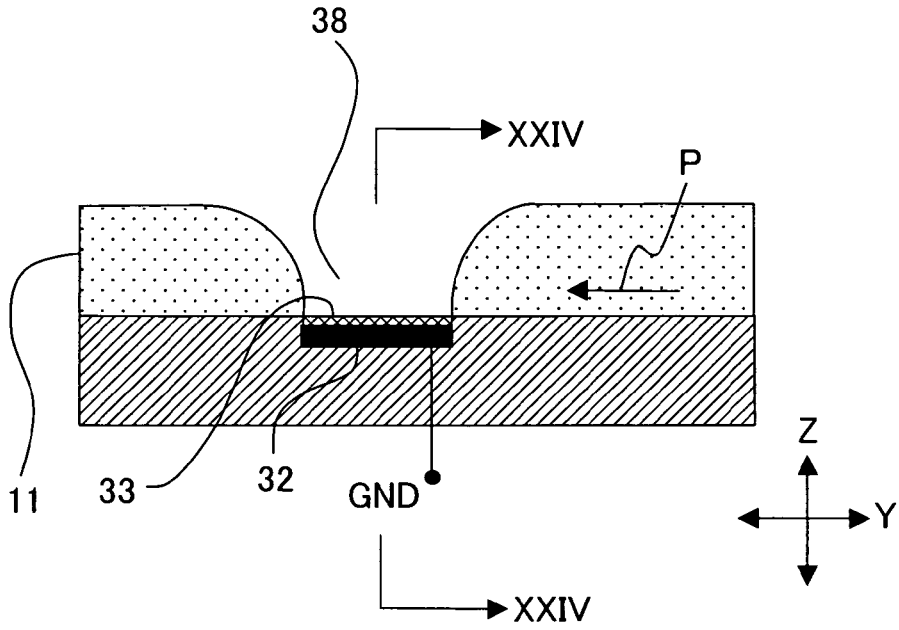
FIG. 23 shows a vertical sectional view illustrating an individual flow passage taken in a flow direction of an ink according to a fourth modified embodiment of the head shown in FIG. 1.
Figure 24:
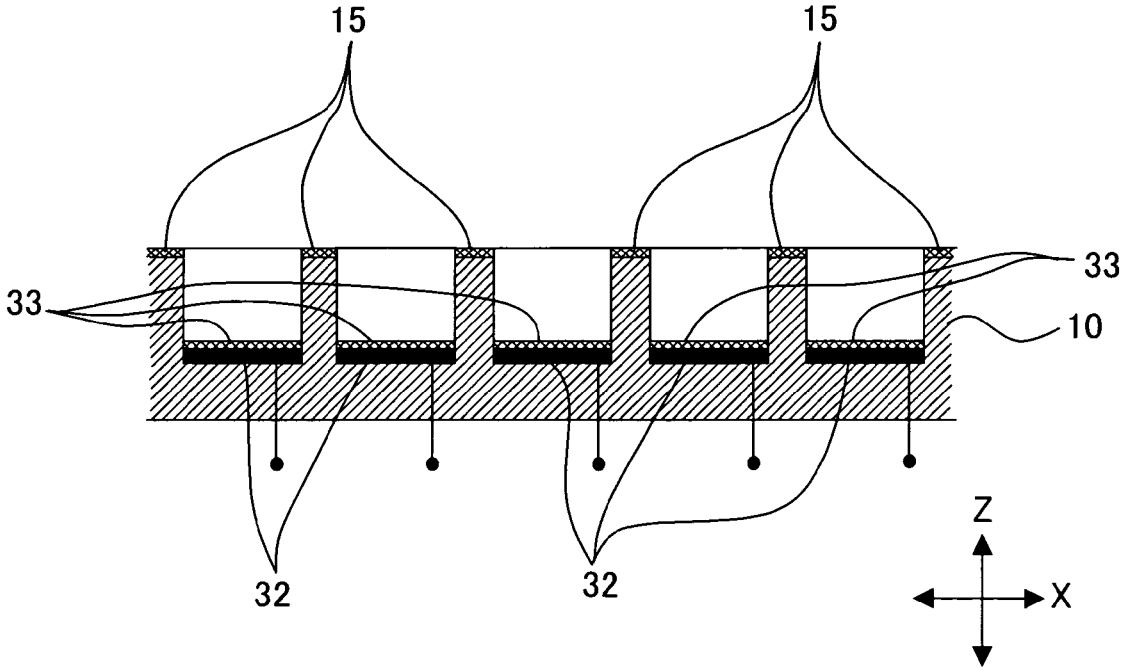
FIG. 24 shows a partial sectional view taken along a line XXIV-XXIV illustrating the individual flow passages shown in FIG. 23.

Further, a fourth modified embodiment in relation to the first embodiment is shown in FIGS. 23 and 24. FIG. 23 shows a vertical sectional view of the individual flow passage 38 taken in the flow direction of the ink. FIG. 24 shows a part of a cross section of the individual flow passage 38 shown in FIG. 23 taken along a line XXIV-XXIV. The first embodiment has been explained in relation to the case in which the cross section of the individual flow passage 38 is rectangular. However, as shown in FIG. 24, the cross section of the individual flow passage 38 according to this modified embodiment is recessed. Therefore, in this modified embodiment, the structure of the ink discharge unit 10 is further simplified, which can be produced at low cost. In this modified embodiment, the high liquid repellence layer 15, which has the liquid repellence higher than that of the inner wall of the individual flow passage 38, is formed on each of the upper surfaces which compart the respective individual flow passages 38. Therefore, it is possible to suppress the leakage of the ink contained in the individual flow passage 38 into the adjacent individual flow passage 38.

The second embodiment has been explained in relation to the case in which the cross section of the individual flow passage 138 is recessed in the same manner as in the modified embodiment described above. However, the cross section of the individual flow passage 138 may be rectangular. Further, the third embodiment has been explained in relation to the case in which the cross section of the individual flow passage 238 is recessed in the same manner as in the modified embodiment described above. However, the cross section of the individual flow passage 238 may be rectangular. However, in this case, it is necessary that an opening, which enables the low liquid repellence plate 231 to pass therethrough, is formed through the upper surface of the individual flow passage 238.

The second embodiment, the third embodiment, and the modified embodiment described above have been explained in relation to the case in which the high liquid repellence layer, which has the liquid repellence higher than that of the inner wall of the individual flow passage, is formed on each of the upper surfaces which compart the respective individual flow passages. However, it is not necessarily indispensable to form the high liquid repellence layer.

Figure 25:
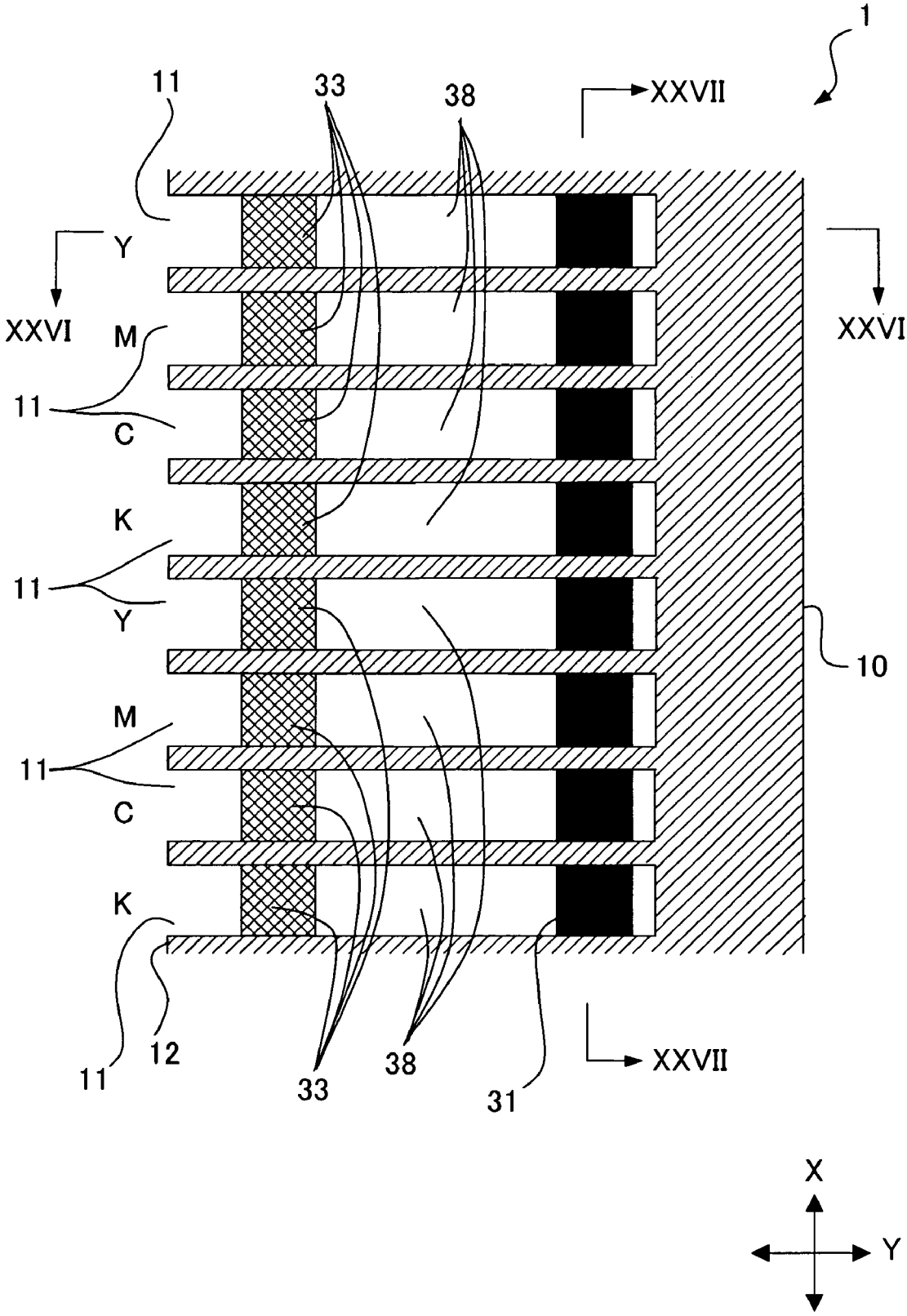
FIG. 25 shows a horizontal sectional view illustrating an ink discharge unit according to a fifth modified embodiment of the head shown in FIG. 1.
Figure 26:
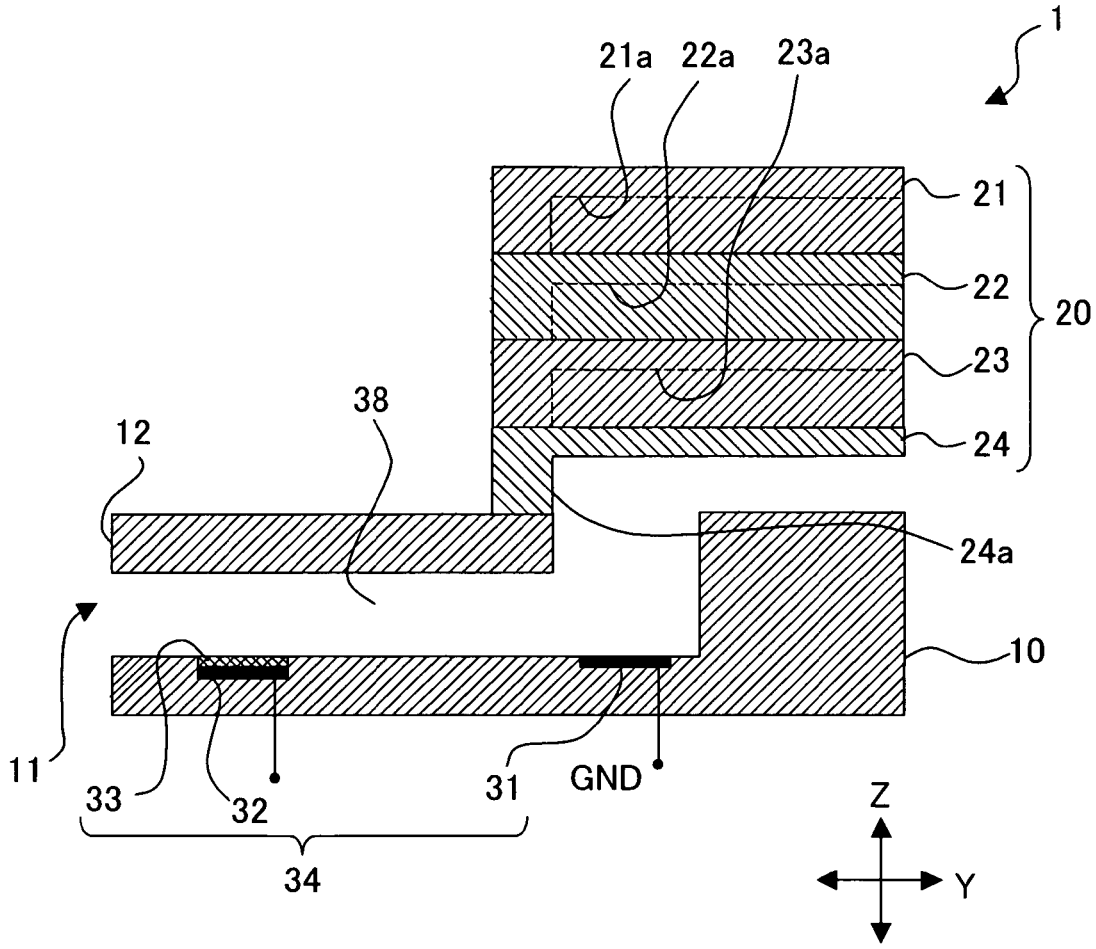
FIG. 26 shows a sectional view taken along a line XXVI-XXVI illustrating the head shown in FIG. 25.
Figure 27:
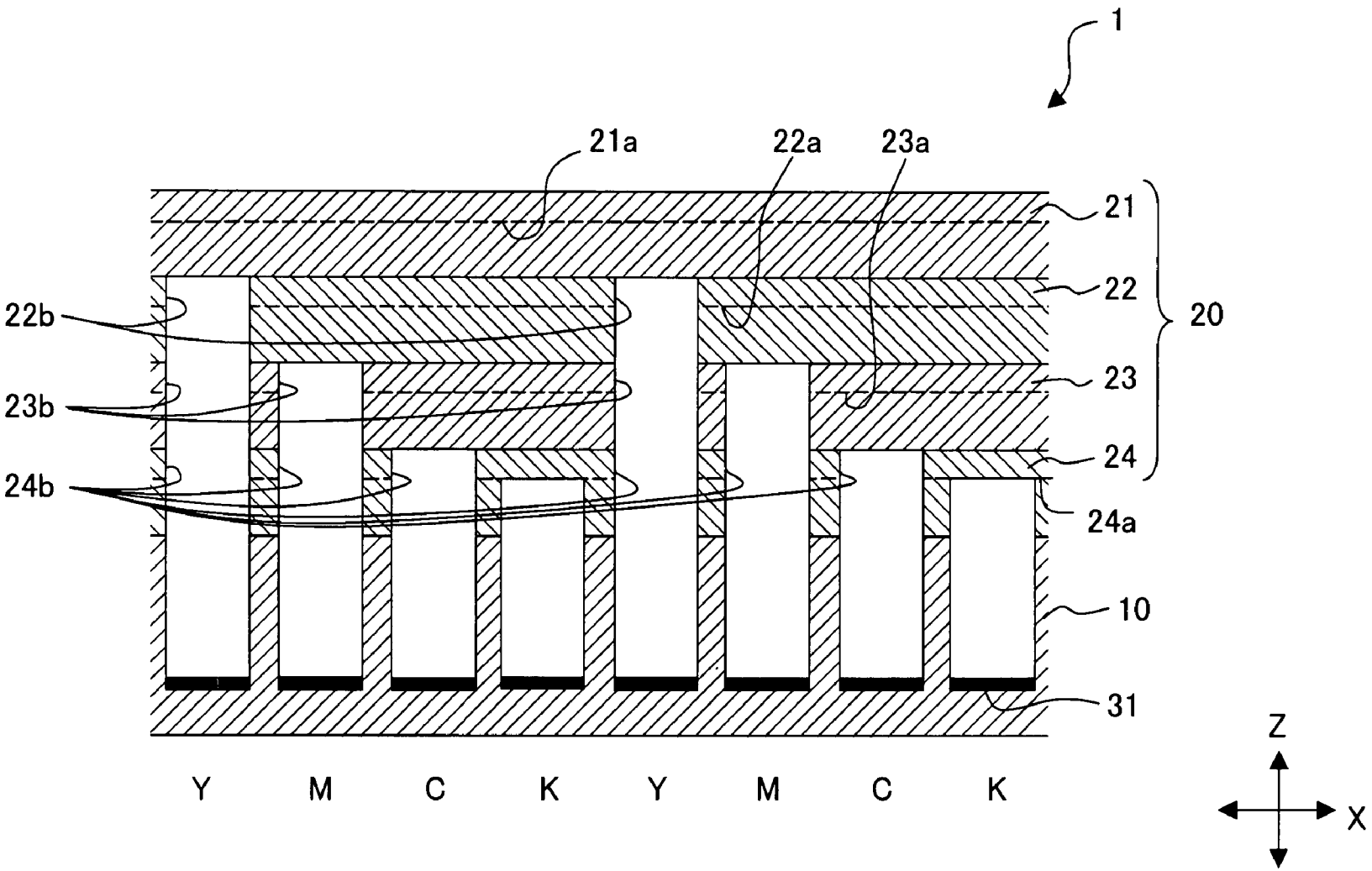
FIG. 27 shows a sectional view taken along a line XXVII-XXVII illustrating the head shown in FIG. 25.

Further, a fifth modified embodiment in relation to the first embodiment is shown in FIGS. 25 to 27. FIGS. 25 and 26 correspond to FIGS. 4 and 5 of the first embodiment respectively. FIG. 27 shows a sectional view taken along a line XXVII-XXVII shown in FIG. 25. An ink discharge unit 10 according to this modified embodiment includes a plurality of individual flow passages 38 which are formed in the Y direction so that ink discharge ports 11, which are arranged to form an array in the X direction, are formed on the ink discharge surface 12. The plurality of individual flow passages 38 are periodically arranged in an order, i.e., the passage for the yellow ink—the passage for the magenta ink—the passage for the cyan ink—the passage for the black ink—the passage for the yellow ink— . . . and so on.

As shown in FIGS. 26 and 27, the ink supply unit 20 according to this modified embodiment includes a yellow ink supply section 21, a magenta ink supply section 22, a cyan ink supply section 23, and a black ink supply section 24. The respective ink supply sections 21 to 24 are substantially rectangular parallelepiped-shaped members respectively, and recesses 21*a* to 24*a*, which are open downwardly, are formed on the lower surfaces thereof respectively. Further, the yellow ink, the magenta ink, the cyan ink, and the black ink are supplied respectively from corresponding ink tanks (not shown) to the spaces which are formed by the recesses 21*a* to 24*a* in the ink supply sections 21 to 24.

As shown in FIG. 27, through-holes 22*b*, 23*b*, 24*b* are formed at portions at which-the recesses 22*a* to 24*a* of the magenta ink supply section 22, the cyan ink supply section 23, and the black ink supply section 24 are not formed respectively so that the respective individual flow passages 38 for the yellow ink are connected to the space which is formed by the recess 21*a* in the yellow ink supply section 21. Similarly, the respective individual flow passages 38 for the magenta ink are connected to the space which is formed by the recess 22*a* in the magenta ink supply section 22. Further, the respective individual flow passages 38 for the cyan ink are connected to the space which is formed by the recess 23*a* in the cyan ink supply section 23. Furthermore, the respective individual flow passages 38 for the black ink are connected to the space which is formed by the recess 24*a* in the black ink supply section 24.

According to the arrangement as described above, this modified embodiment makes it possible to selectively discharge the respective colors of yellow, magenta, cyan, and black from the ink discharge ports 11 respectively. Therefore, it is possible to form a full color image by discharging the inks corresponding to the respective colors onto the printing paper.

The fifth modified embodiment has been explained in relation to the case in which the ink supply unit 20, which resides in the head 1 of the first embodiment, has the four ink supply sections 21 to 24, and the inks of the four colors of yellow, magenta, cyan, and black can be discharged from the ink discharge ports 11. However, in the same manner as described above, the ink supply unit may have four ink supply sections, and the inks of the four colors can be discharged from ink discharge ports as well in the case of the heads of the second embodiment and the third embodiment.

The types of the inks in the fifth modified embodiment are not limited to the four color inks of yellow, magenta, cyan, and black as described above. Any ink having a color other than the four colors may be used. A plurality of inks of one or more types may be used.

Further, the respective first to third embodiments described above have been explained in relation to the exemplary ink passage-permitting mechanism which selectively permits the pressurized ink to pass across the selective passage area in the individual flow passage. Therefore, the structure or arrangement of the ink passage-permitting mechanism is arbitrarily changeable within a range in which an effect equivalent to that obtained in the embodiment of the present invention is obtained.

The first to third embodiments described above have been explained in relation to the case in which the pressure, which is finely varied or fluctuated, is applied to the ink. However, there is no limitation thereto. The pressure, which is applied to the ink, may be constant.

Additionally, the first embodiment described above has been explained in relation to the case in which the common electrode 31 is formed on the side opposite to the ink discharge port 11 with respect to the selective passage area. However, there is no limitation thereto. The common electrode 31 may be disposed at a position deviated from the selective passage area toward the ink discharge port 11. The case, in which the common electrode 31 is formed in the common flow passage 39, has been explained. However, the common electrode 31 may be provided in each of the individual flow passages 38.

The second embodiment described above has been explained in relation to the case in which the projection 117 is formed at the position opposed to the high liquid repellence film 114 in the individual flow passage 138 on the lower surface of the ink discharge unit 110. However, there is no limitation thereto. For example, the following arrangement is also available. That is, the projection 117 is not formed. The recess 116 is formed on the lower surface of the ink discharge unit 110 so that the both ends of the high liquid repellence film 114 in the Y direction in the individual flow passage 138 are opposed to the both ends of the recess 116 in the Y direction. Further, the actuator 131 is arranged between the both side surfaces of the recess 116 in the Y direction. The both side surfaces of the recess 116 in the Y direction are vibrated in the Y direction.

The second embodiment described above has been explained in relation to the case in which the boundary line of the high liquid repellence film 114, which is disposed on the side of the ink discharge port 111, is composed of the straight line which is perpendicular to the flow direction of the ink. The boundary line, which is disposed on the side opposite to the ink discharge port 111, has the zigzag shape such that the straight lines, which have the opposite directions of inclination with respect to the straight line perpendicular to the flow direction of the ink, are alternately aligned. However, there is no limitation thereto. The high liquid repellence film 114 may have any shape provided that the upstream side ink easily passes across the high liquid repellence film 114 when the force, which is applied to the ink toward the downstream side in the flow direction, is increased. For example, islands of low liquid repellence areas having low liquid repellence may be provided on the surface of the high liquid repellence film 114, and the number of the islands of low liquid repellence areas may be larger on the side opposite to the ink discharge port 111 than on the side of the ink discharge port. The boundary line, which is disposed on the side of the ink discharge port 111, may have the same shape as that of the boundary line which is disposed on the side opposite to the ink discharge port 111.

The second embodiment described above has been explained in relation to the case in which the projection 117 is vibrated by the actuator 131. However, the oscillation mechanism for vibrating the projection 117 is not limited thereto. For example, the projection 117 may be vibrated by using a motor.

The third embodiment described above has been explained in relation to the case in which the low liquid repellence plate 231 is displaced in the Z direction by attaching the low liquid repellence plate 231 to the actuator 232 in which the length is variable in the Z direction. However, the driving mechanism for displacing the low liquid repellence plate 231 is not limited thereto. For example, the low liquid repellence plate 231 may be attached to a tip of a rod-shaped metal member, and the metal member may be elongated or shrunk by heating or cooling the metal member to displace the low liquid repellence plate 231.

Additionally, the first to third embodiments described above have been explained in relation to the case in which the ink contained in the ink tank is pressurized to supply the pressurized ink to the head by supplying the air to the ink tank by the pump provided for the air supply tube. However, the method for supplying the pressurized ink to the head is not limited thereto. For example, the ink tank may be arranged at a position higher than that of the head, and the pressurized ink may be supplied to the head in accordance with the water head pressure.

The first to third embodiments described above have been explain in relation to the case in which the voltage application control section is used to adjust the volume of the ink per one droplet to be discharged from the ink discharge port in order that the gradational printing can be preformat at multiple stages. However, the voltage application control section may be omitted.

Further, the first to third embodiments described above have been explained in relation to the printer which is capable of selectively discharging the ink. However, the range of application of the present invention is not limited thereto. For example, a plurality of types of chemical liquids may be supplied into the respective individual flow passages, and they may be selectively discharged to thereby make the use of a microfactory in which the chemical liquids are dispensed in a predetermined order to observe the reaction. Alternatively, it is also allowable to make the use of a microvalve to be provided in a micromachine.

What is claimed is:

1. A liquid transport head comprising:

a liquid passage-permitting mechanism; and a flow passage which has a liquid discharge port and which includes a first area and a second area formed on an inner wall which makes contact with a liquid, the second area being adjacent to the first area in a flow direction of the liquid and having liquid repellence higher than that of the first area, wherein the liquid, which is pressurized to move toward the liquid discharge port, is incapable of passing through the second area to move toward the liquid discharge port, and thus a bubble clogs the flow passage in the second area until the liquid passage-permitting mechanism selectively permits the pressurized liquid to pass through the second area, wherein the liquid passage-permitting mechanism includes:

a first electrode which is formed at a position different from a position corresponding to the second area;

an insulator which is formed as an inner wall of the flow passage in the second area; and a second electrode which is electrically connected to the insulator.

2. The liquid transport head according to claim 1, wherein a pressure, which is applied to the liquid, is varied.

3. The liquid transport head according to claim 2, wherein the liquid is an ink.

4. The liquid transport head according to claim 2, wherein the flow passage has a plurality of individual flow passages, and the liquid discharge port includes discharge ports which correspond to the plurality of individual flow passages and which are arranged to form an array.

5. The liquid transport head according to claim 4, further comprising a first common flow passage which is connected to an individual flow passage of the individual flow passages assigned by an ordinal number of (n×N+1), a second common flow passage which is connected to an individual flow passage assigned by an ordinal number of (n×N+2), . . . , and an nth common flow passage which is connected to an individual flow passage assigned by an ordinal number of (n×N+n) as counted from an individual flow passage disposed at an outermost end provided that n represents a fixed natural number of not less than 2, and N represents a variable integer of not less than 0, wherein n pieces of the common flow passages are formed at positions different in distance with respect to the associated individual flow passages respectively.

6. The liquid transport head according to claim 5, wherein the n pieces of the common flow passages are filled with inks which have different colors as the liquid respectively.

7. The liquid transport head according to claim 4, further comprising a common flow passage which is commonly connected to the plurality of individual flow passages.

8. The liquid transport head according to claim 2, wherein the flow passage has an atmospheric air communication hole which is formed at a position corresponding to the second area in the flow direction of the liquid.

9. A liquid transport apparatus comprising:

a liquid transport head according to claim 2;

a pressurizing mechanism which pressurizes a liquid in the liquid transport head in a direction directed toward the liquid discharge port; and a control unit which controls the liquid transport head, wherein the liquid passage-permitting mechanism selectively permits the pressurized liquid to pass through the second area on the basis of control of the control unit.

10. The liquid transport apparatus according to claim 9, wherein the pressurizing mechanism applies a varying pressure to the liquid in the liquid transport head.

11. The liquid transport apparatus according to claim 9, wherein the control unit is capable of adjusting a time to vibrate the inner wall of the flow passage.

12. The liquid transport apparatus according to claim 9, wherein the apparatus is an ink-jet printer which jets an ink.

13. The liquid transport head according to claim 1, wherein one or more bumps are formed at one or more positions corresponding to one or more edges of the second area in the flow direction of the liquid on the inner wall.

14. The liquid transport head according to claim 13, wherein the liquid is an ink.

15. The liquid transport head according to claim 13, wherein the flow passage has a plurality of individual flow passages, and the liquid discharge port includes discharge ports which correspond to the plurality of individual flow passages and which are arranged to form an array.

16. The liquid transport head according to claim 15, further comprising a first common flow passage which is connected to an individual flow passage of the individual flow passages assigned by an ordinal number of (n×N+1), a second common flow passage which is connected to an individual flow passage assigned by an ordinal number of (n×N+2), . . . , and an nth common flow passage which is connected to an individual flow passage assigned by an ordinal number of (n×N+n) as counted from an individual flow passage disposed at an outermost end provided that n represents a fixed natural number of not less than 2, and N represents a variable integer of not less than 0, wherein n pieces of the common flow passages are formed at positions different in distance with respect to the associated individual flow passages respectively.

17. The liquid transport head according to claim 16, wherein the n pieces of the common flow passages are filled with inks which have different colors as the liquid respectively.

18. The liquid transport head according to claim 15, further comprising a common flow passage which is commonly connected to the plurality of individual flow passages.

19. The liquid transport head according to claim 13, wherein the flow passage has an atmospheric air communication hole which is formed at a position corresponding to the second area in the flow direction of the liquid.

20. A liquid transport apparatus comprising:

a liquid transport head according to claim 13;

a pressurizing mechanism which pressurizes a liquid in the liquid transport head in a direction directed toward the liquid discharge port; and a control unit which controls the liquid transport head, wherein the liquid passage-permitting mechanism selectively permits the pressurized liquid to pass through the second area on the basis of control of the control unit.

21. The liquid transport apparatus according to claim 20, wherein the pressurizing mechanism applies a varying pressure to the liquid in the liquid transport head.

22. The liquid transport apparatus according to claim 20, wherein the control unit is capable of adjusting a time to retain the low liquid repellence member at the position at which the surface of the low liquid repellence member makes contact with the liquid in the flow passage.

23. The liquid transport apparatus according to claim 20, wherein the apparatus is an ink-jet printer which jets an ink.

24. The liquid transport head according to claim 1, wherein a surface of the second area, which makes contact with the liquid, protrudes as compared with a surface of the first area which makes contact with the liquid.

25. The liquid transport head according to claim 1, wherein the flow passage has an opening which is open to atmospheric air so that a cross section of the flow passage is formed to be recessed, and the opening extends in the flow direction of the liquid.

26. The liquid transport head according to claim 25, wherein an outer wall of the flow passage, with which the opening is formed, is formed to have liquid repellence which is higher than that of the first area.

27. The liquid transport head according to claim 1, wherein the liquid is an ink.

28. The liquid transport head according to claim 1, wherein the flow passage has a plurality of individual flow passages, and the liquid discharge port includes discharge ports which correspond to the plurality of individual flow passages and which are arranged to form an array.

29. The liquid transport head according to claim 28, further comprising a first common flow passage which is connected to an individual flow passage of the individual flow passages assigned by an ordinal number of (n×N+1), a second common flow passage which is connected to an individual flow passage assigned by an ordinal number of (n×N+2), . . . , and an nth common flow passage which is connected to an individual flow passage assigned by an ordinal number of (n×N+n) as counted from an individual flow passage disposed at an outermost end provided that n represents a fixed natural number of not less than 2, and N represents a variable integer of not less than 0, wherein n pieces of the common flow passages are formed at positions different in distance with respect to the associated individual flow passages respectively.

30. The liquid transport head according to claim 29, wherein the n pieces of the common flow passages are filled with inks which have different colors as the liquid respectively.

31. The liquid transport head according to claim 28, further comprising a common flow passage which is commonly connected to the plurality of individual flow passages.

32. The liquid transport head according to claim 1, wherein the first electrode is formed on a side opposite to the liquid discharge port with respect to the position corresponding to the second area.

33. The liquid transport head according to claim 1, wherein the first electrode is formed in the common flow passage.

34. The liquid transport head according to claim 1, wherein the flow passage has an atmospheric air communication hole which is formed at a position corresponding to the second area in the flow direction of the liquid.

35. A liquid transport apparatus comprising:

a liquid transport head according to claim 1;

a pressurizing mechanism which pressurizes a liquid in the liquid transport head in a direction directed toward the liquid discharge port; and a control unit which controls the liquid transport head, wherein the liquid passage-permitting mechanism selectively permits the pressurized liquid to pass through the second area on the basis of control of the control unit.

36. The liquid transport apparatus according to claim 35, wherein the pressurizing mechanism applies a varying pressure to the liquid in the liquid transport head.

37. The liquid transport apparatus according to claim 35, wherein the control unit is capable of adjusting a time to apply a voltage between the first electrode and the second electrode.

38. The liquid transport apparatus according to claim 35, wherein the apparatus is an ink-jet printer which jets an ink.

39. A liquid transport apparatus comprising a liquid transport head according to claim 1, wherein a liquid is conductive, and the liquid is permitted to pass through the second area from the first area depending on a voltage applied to the electrode.

40. The liquid transport apparatus according to claim 39, further comprising another electrode which makes contact with the liquid, wherein a liquid discharge port is connected to the first area.

* * * * *